US005270769A

United States Patent [19]

Satoh et al.

[11] Patent Number: 5,270,769

[45] Date of Patent: Dec. 14, 1993

[54] ELECTROPHOTOGRAPHIC APPARATUS FOR FORMATION OF COLOR IMAGE ON INTERMEDIATE TRANSFER DEVICE

[75] Inventors: Norihide Satoh, Chikushino; Yuzo Kawano, Ohnojo; Yuji Toyomura, Fukuoka, all of Japan

[73] Assignee: Matsushita Electric Industrial Co., Ltd., Osaka, Japan

[21] Appl. No.: 838,647

[22] Filed: Feb. 20, 1992

[30] Foreign Application Priority Data

Feb. 21, 1991 [JP] Japan ..... 3-27386
Feb. 28, 1991 [JP] Japan ..... 3-33990
Jul. 23, 1991 [JP] Japan ..... 3-182199

[51] Int. Cl.[5] ..... G03G 15/16

[52] U.S. Cl. ..... 355/272; 355/204; 355/210; 355/277; 355/326 R

[58] Field of Search ..... 355/271, 274, 277, 272, 355/279, 326, 327, 203-209, 210, 211, 212

[56] References Cited

U.S. PATENT DOCUMENTS 4,518,976 5/1985 Tarumi et al. ..... 346/153.1
4,556,311 12/1985 Tagoku ..... 355/212 X
4,652,115 3/1987 Palm et al. .
4,821,066 4/1989 Foote, Jr. et al. ..... 346/157 X
4,872,037 10/1989 Kasahara et al. ..... 355/271
4,903,067 2/1990 Murayama et al. ..... 346/160
5,021,835 6/1991 Johnson ..... 355/271
5,043,761 8/1991 Johnson ..... 355/326

FOREIGN PATENT DOCUMENTS 63-292156 11/1988 Japan .

*Primary Examiner*—A. T. Grimley
*Assistant Examiner*—T. A. Dang
*Attorney, Agent, or Firm*—Lowe, Price, LeBlanc & Becker

[57] ABSTRACT

An electrophotographic apparatus equipped with a photosensitive device rotatable which is responsive to exposure light so as to allow formation of a toner image thereon and an intermediate transfer device rotatable which is brought into contact with the photosensitive device so that the toner image formed on the photosensitive device are transferred onto a surface of the intermediate transfer device. The photosensitive device has a reference mark indicative of a predetermined position in its rotational direction and the intermediate transfer device also has a reference mark representative of a predetermined position in its rotational direction. These reference marks are detected by first and second reference position sensors, thereby measuring the rotational periods of the photosensitive device and the intermediate transfer device so as to calculate a difference therebetween. A control section controls start timings of the formations of the toner images on the photosensitive device on the basis of the calculated period difference as time periods from the time that the first reference position sensor detects the reference mark of the photosensitive device.

11 Claims, 35 Drawing Sheets

FIG. 8A (FIRST-PAGE IMAGE FORMATION)
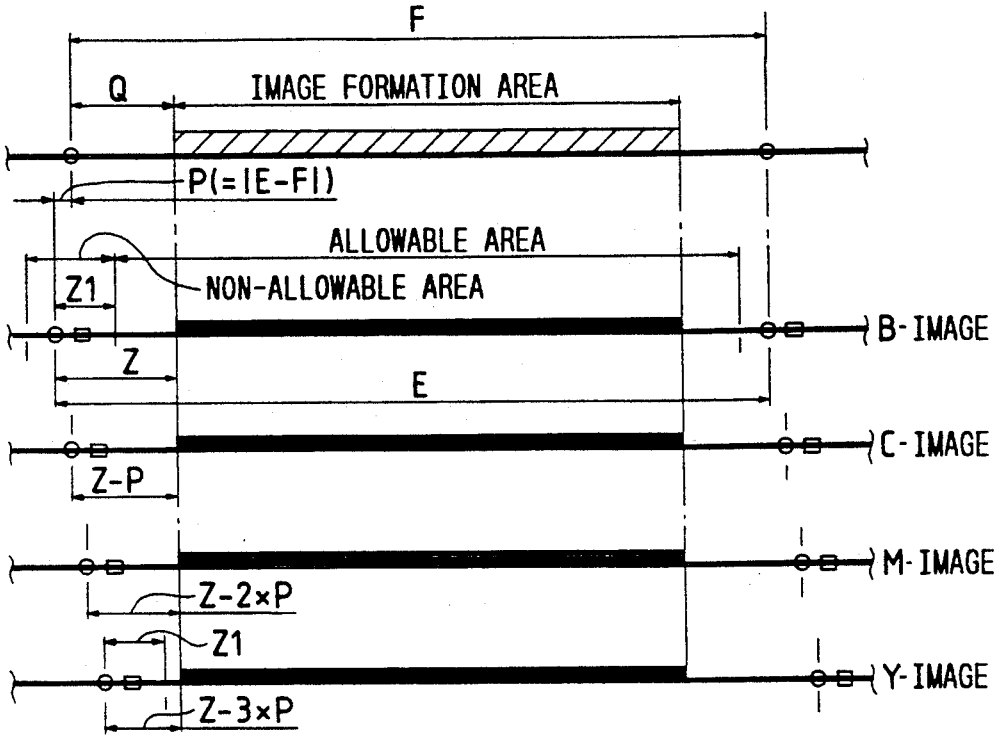
FIG. 8B (SECOND-PAGE IMAGE FORMATION)
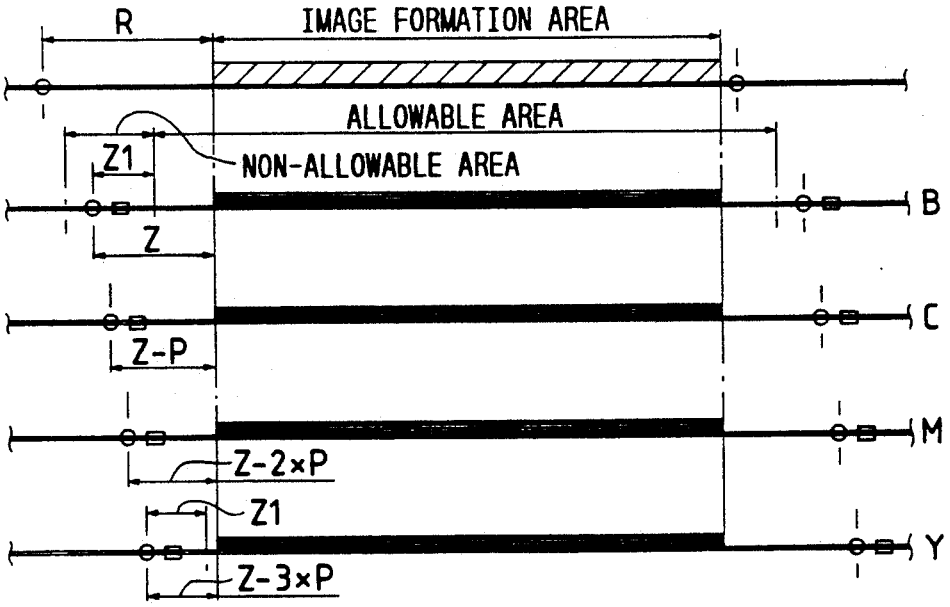

FIG. 10A (FIRST-PAGE IMAGE FORMATION)
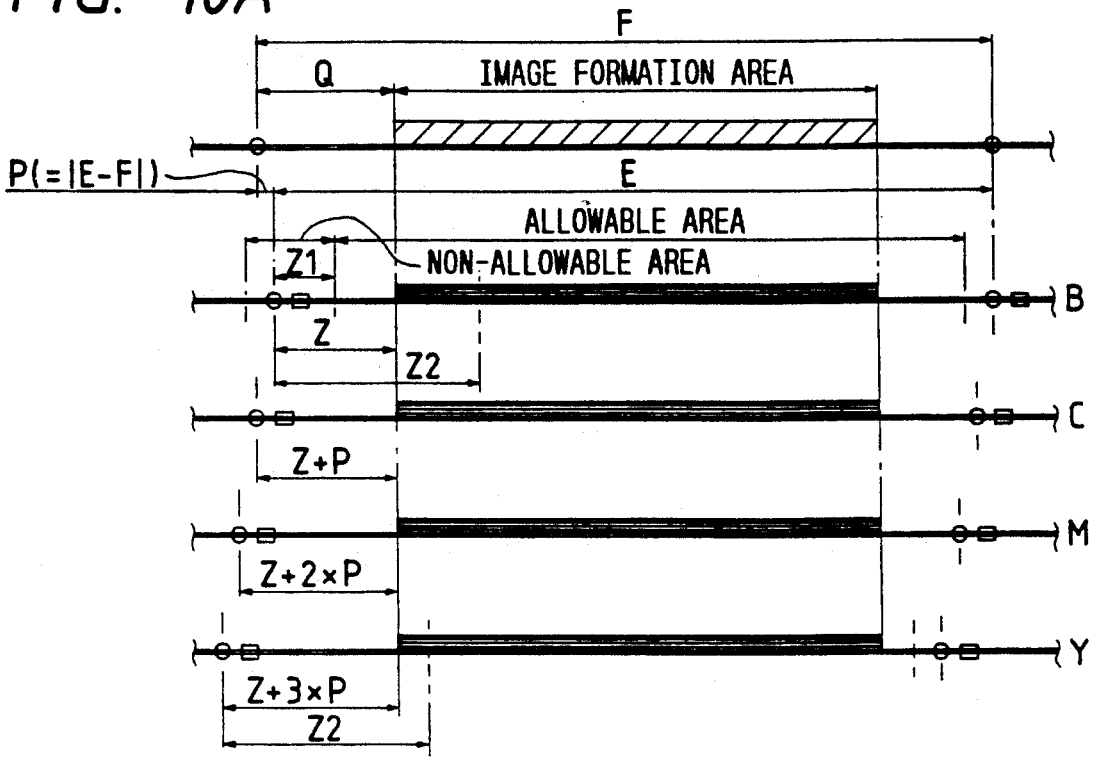
FIG. 10B (SECOND-PAGE IMAGE FORMATION)
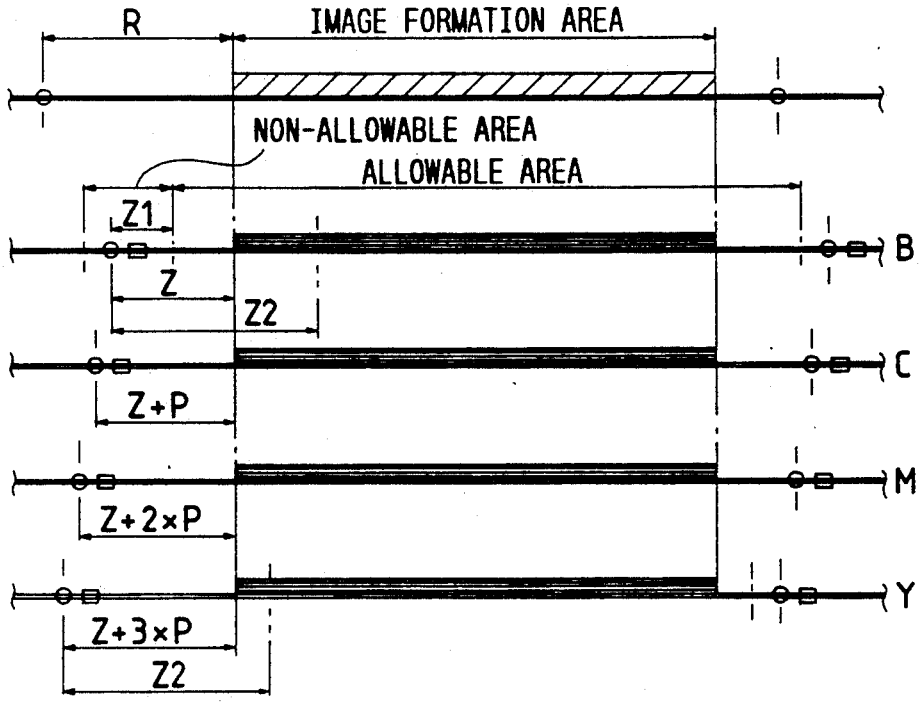

FIG. 17A (FIRST-PAGE IMAGE FORMATION)
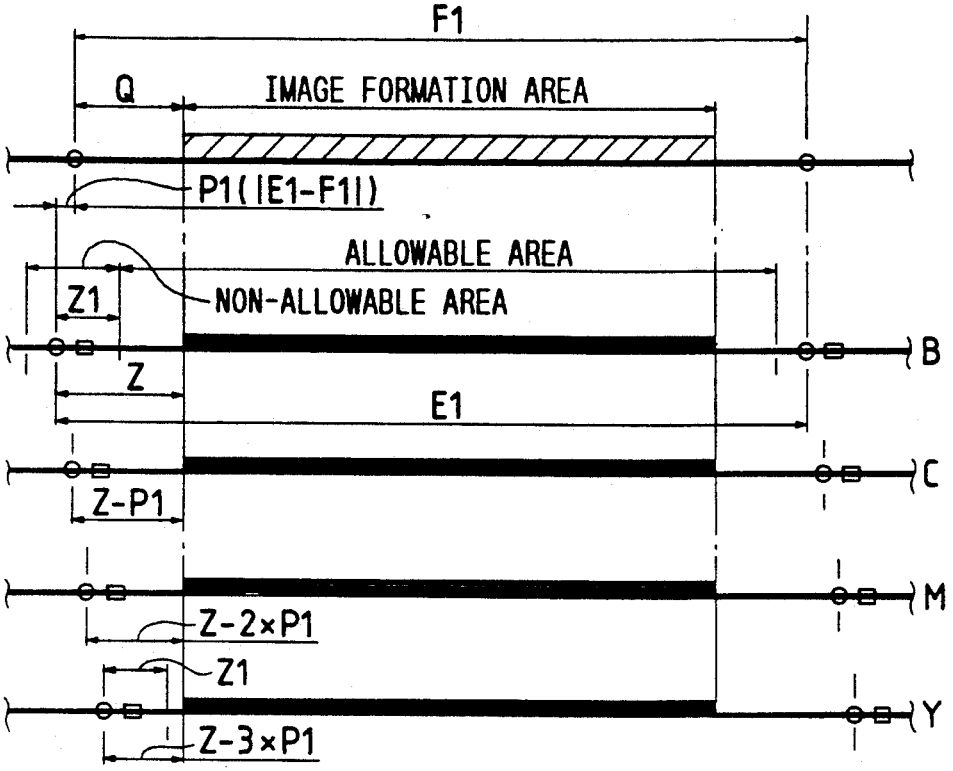
FIG. 17B (SECOND-PAGE IMAGE FORMATION)
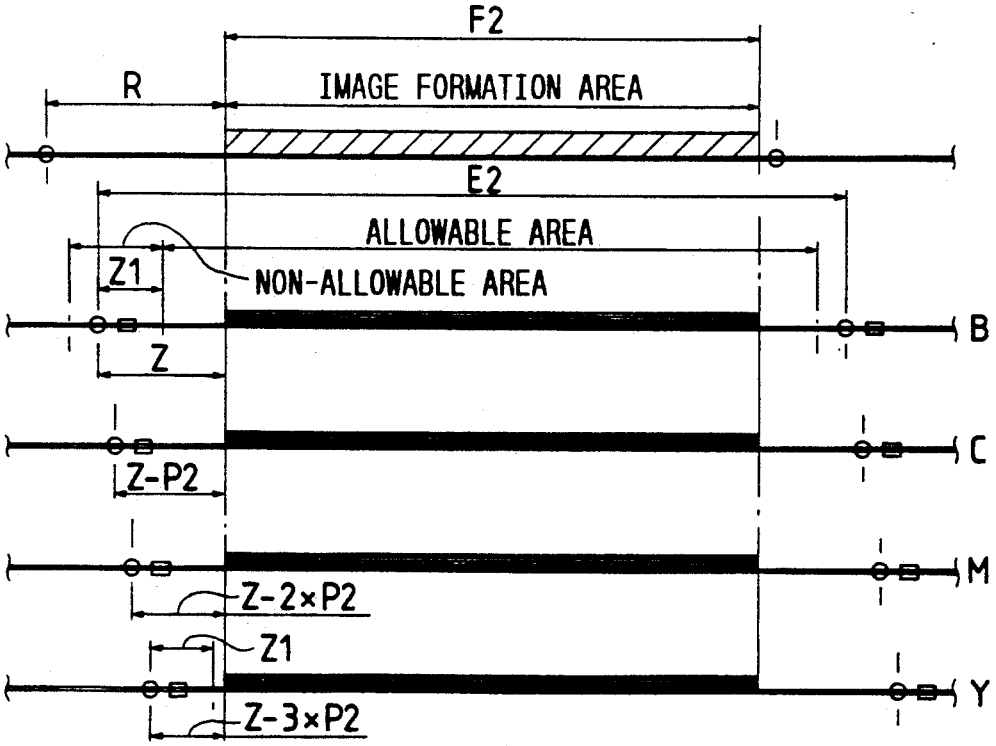

FIG. 19A (FIRST-PAGE IMAGE FORMATION)
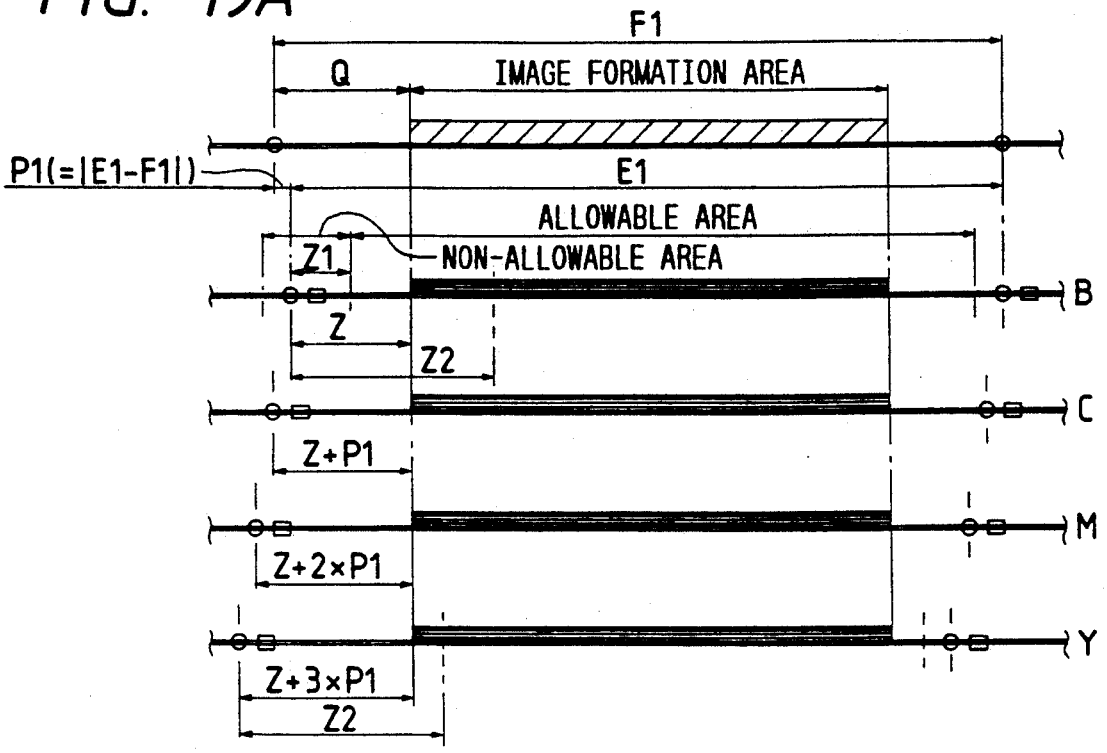
FIG. 19B (SECOND-PAGE IMAGE FORMATION)
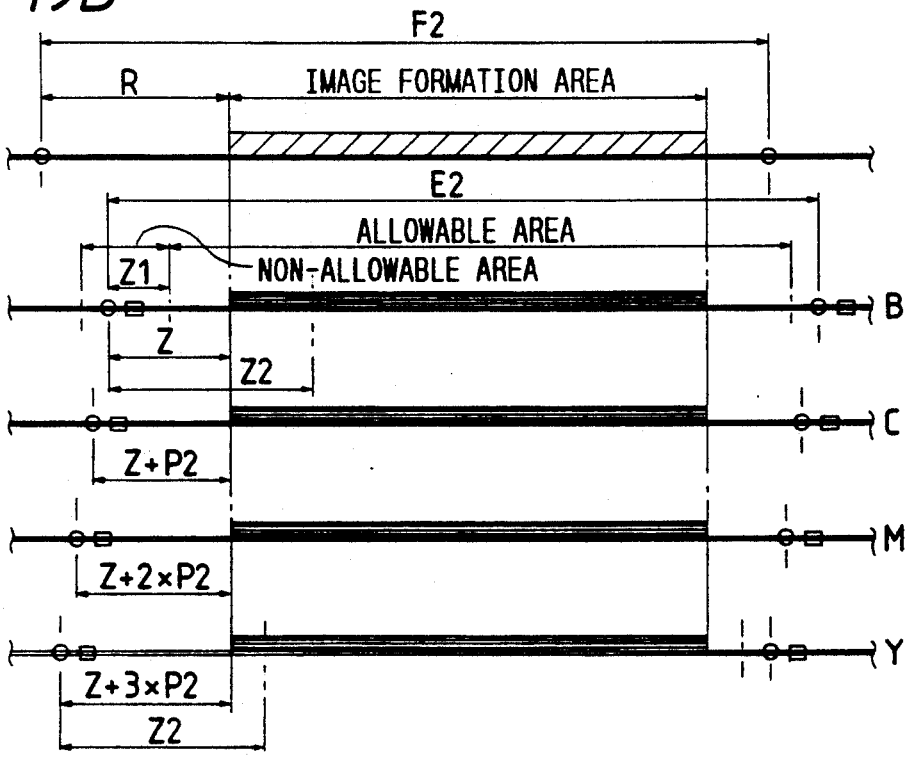

FIG. 22A (FIRST-PAGE IMAGE FORMATION)
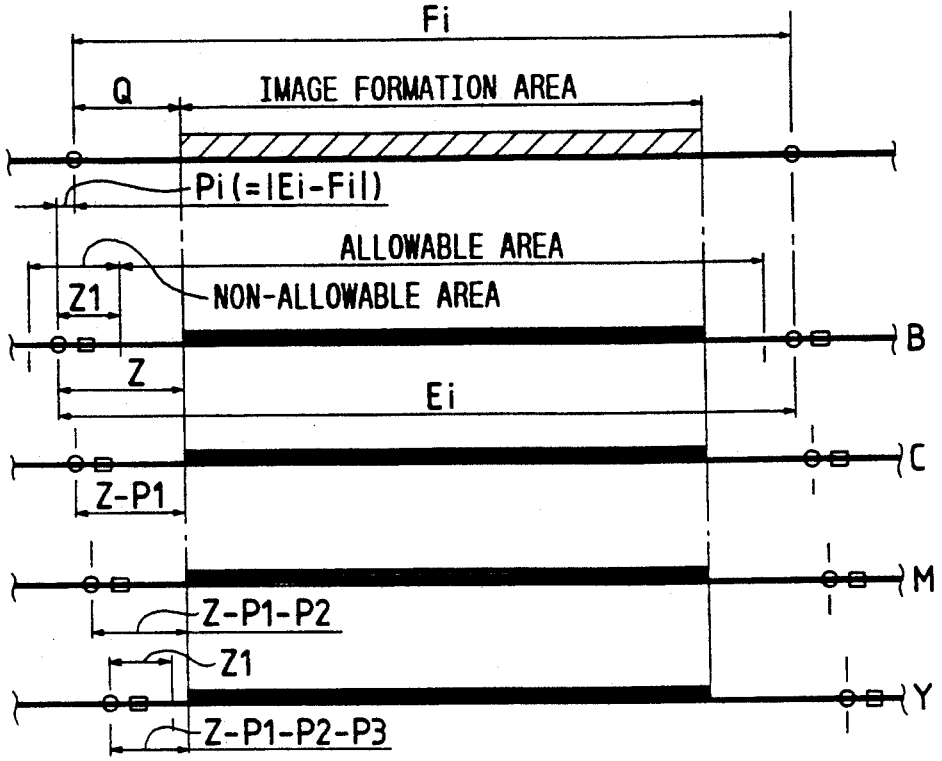
FIG. 22B (SECOND-PAGE IMAGE FORMATION)
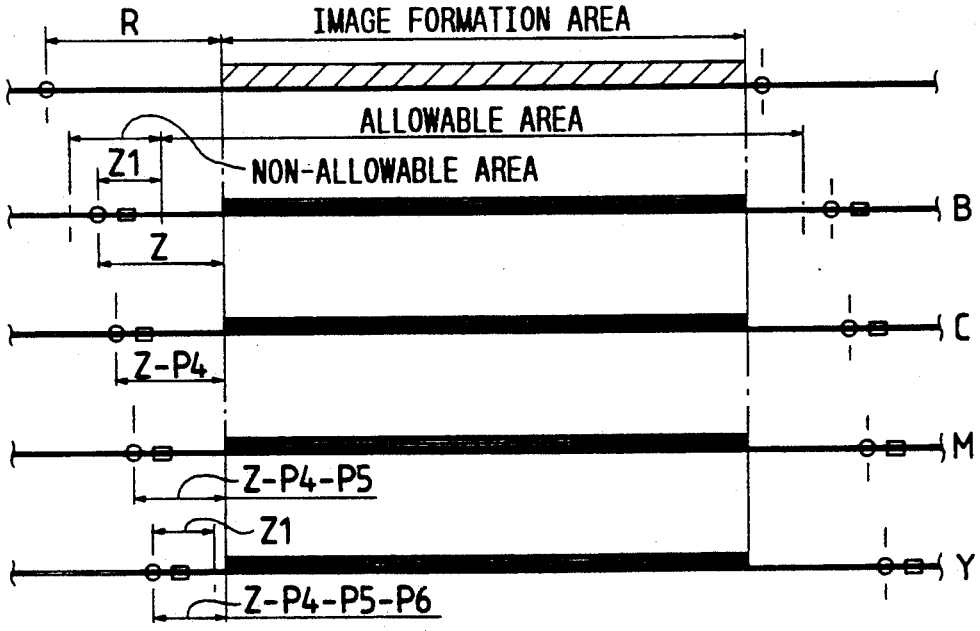

FIG. 24A (FIRST-PAGE IMAGE FORMATION)
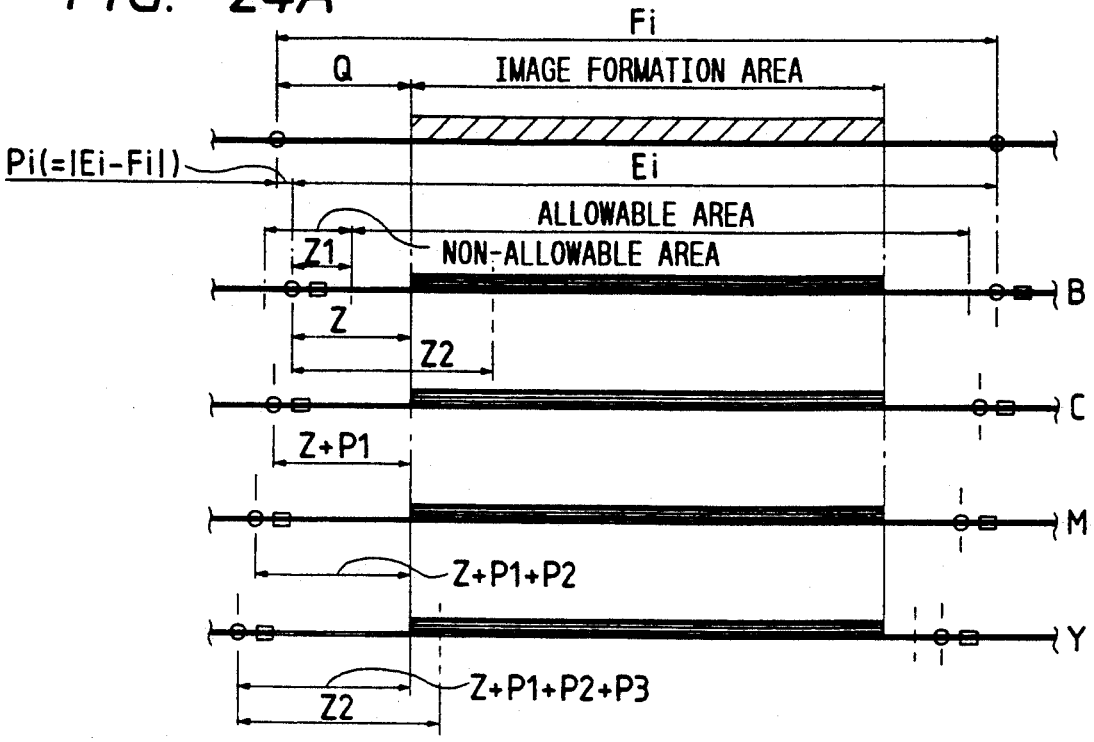
FIG. 24B (SECOND-PAGE IMAGE FORMATION)
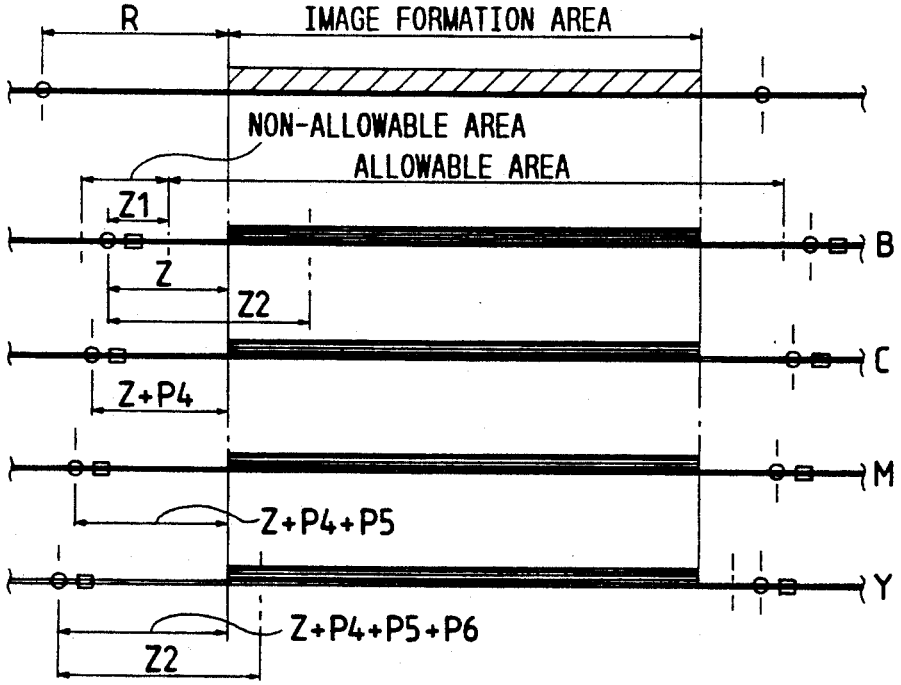

ELECTROPHOTOGRAPHIC APPARATUS FOR FORMATION OF COLOR IMAGE ON INTERMEDIATE TRANSFER DEVICE

BACKGROUND OF THE INVENTION

The present invention relates to an electrophotographic apparatus for forming a color-combination image with a plurality of single-color toner images being formed on a photosensitive device and once transferred onto an intermediate transfer device, and more particularly to such an electrophotographic apparatus which controls the image-formation start timings on the photosensitive device.

As one of color-image formation apparatus based on the electrophotographic process technique, there is known an electrophotographic apparatus which is arranged such that a plurality of different-color exposure beams are selectively directed to a photosensitive device to be imaged thereon so as to form a plurality of electrostatic latent images, and the plurality of formed electrostatic latent images are developed with toners having a plurality of different colors so as to form a plurality of toner images which are in turn overlapped with each other to form a color image on a copy sheet. For example, in U.S. Pat. No. 4,652,115 or the Japanese Patent Provisional Publication No. 63-292156, there is disclosed a system in which an intermediate transfer device is placed between a photosensitive device and a copy-sheet carrying device and a plurality of single-color toner images having different colors are successively overlapped and transferred on the intermediate transfer device so as to obtain a combined color image which is in turn transferred onto a copy sheet. Here, for overlapping the plurality of toner images on the intermediate transfer device, various attempts are made for preventing the deterioration of the image due to the dislocation in overlapping between the plurality of toner images. However, such conventional electrophotographic apparatus makes difficult the fine alignment between the photosensitive device and the intermediate transfer device at every color, requires a complicated mechanism such as a clutch mechanism for the positional adjustment between the photosensitive device and the intermediate transfer device and provides the possibility that the photosensitive device and the intermediate transfer device are damaged in the positional adjustment, as will hereinafter be described in detail.

SUMMARY OF THE INVENTION

It is therefore an object of the present invention to provide a long-life and high-reliability electrophotographic apparatus which is capable of performing fine and accurate alightment between different-color images and preventing the damages of the photosensitive device and the intermediate transfer device.

An electrophotographic apparatus according to the present invention is equipped with photosensitive means arranged to be rotatable with a first period in a first predetermined direction and having a photosensitive layer on its one surface which is responsive to an exposure light beam so as to allow continuous formation of a plurality of images for each of a plurality of color pictures, and further equipped with intermediate transfer means arranged to be rotatable with a second period in a second predetermined direction and arranged to be brought into contact with the photosensitive layer of the photosensitive means so that the plurality of images for each of the color pictures formed on the photosensitive layer are transferred onto a surface of the intermediate transfer means, the transferred images being integrally transferred onto a copy sheet to form each of the plurality of color pictures thereon. In addition, the photosensitive means has a first reference mark indicative of a predetermined position of the photosensitive means in the first predetermined rotational direction and the intermediate transfer means has a second reference mark indicative of a predetermined position of the intermediate transfer means in the second predetermined rotational direction. First reference position sensor means detects the first reference mark of the photosensitive means and outputs a detection signal indicative of the detection of the first reference mark and second reference position sensor means detects the second reference mark of the intermediate transfer means and outputs a detection signal indicative of the detection of the second reference mark. Period difference calculating means is responsive to the detection signals from the first and second reference position sensor means so as to calculate a difference between the first rotational period of the photosensitive means and the second rotational period of the intermediate transfer means and control means coupled to said period difference calculating means controls a start timing of the formation of each of the plurality of images on the photosensitive layer of said photosensitive means on the basis of the period difference calculated by the period difference calculating means.

Preferably, the electrophotographic apparatus further comprises decision means for checking whether the image-formation start timing for a final image of the plurality of images for a first color picture of the plurality of color pictures which is determined by the control means is in a predetermined range based on a predetermined time period from a time that said first reference position sensor means outputs said detection signal indicative of the detection of said first reference mark of said photosensitive means. The control means determines the image-formation start timing for the final image as an image-formation start timing for a first image of the plurality of images for a second color picture of the plurality of color pictures when the image-formation start timing for the final image is in the predetermined range, and the control means sets the image-formation start timing for the first image for the second color picture to a predetermined start timing when it is out of the predetermined range.

BRIEF DESCRIPTION OF THE DRAWINGS

The object and features of the present invention will become more readily apparent from the following detailed description of the preferred embodiments taken in conjunction with the accompanying drawings in which:

FIGS. 8A, 8B and 9 are illustrations for describing the image-formation start timing control operation of the first embodiment of this invention in the case that the period of a photosensitive device is longer than the period of an intermediate transfer device;

FIGS. 10A, 10B and 11 are illustrations for describing the image-formation start timing control operation of the first embodiment of this invention in the case that the period of a photosensitive device is shorter than the period of an intermediate transfer device;

FIGS. 17A, 17B and 18 are illustrations of the image-formation start timing control of the third embodiment in the case that the period (E) of the photosensitive device is longer than the period of the intermediate transfer device;

FIGS. 19A, 19B and 20 are illustrations of the image-formation start timing control of the third embodiment in the case that the period of the photosensitive device is shorter than the period of the intermediate transfer device;

FIGS. 22A, 22B and 23 are illustrations of the image-formation start timing control operation of an electrophotographic apparatus of the fourth embodiment in the case that the period of the photosensitive device is longer than the period of the intermediate transfer device;

FIGS. 24A, 24B and 25 are illustrations of the image-formation start timing control operation of the fourth embodiment in the case that the period of the photosensitive device is shorter than the period of the intermediate transfer device;

DETAILED DESCRIPTION OF THE INVENTION

Figure 1:
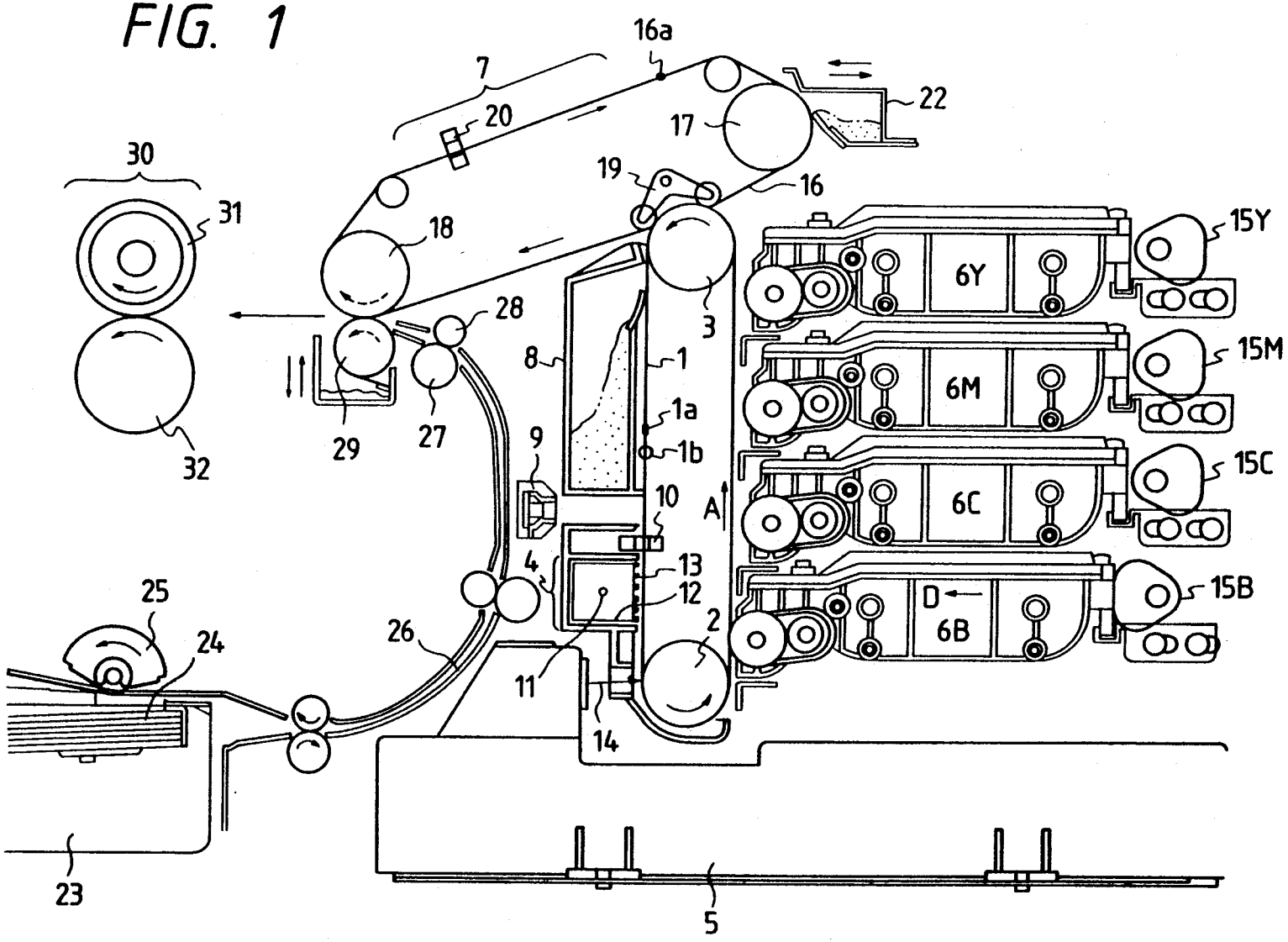
FIG. 1 is a partially cross-sectional view showing an arrangement of a conventional electrophotographic apparatus and an electrophotographic apparatus to which the present invention is applicable.
Figure 2:
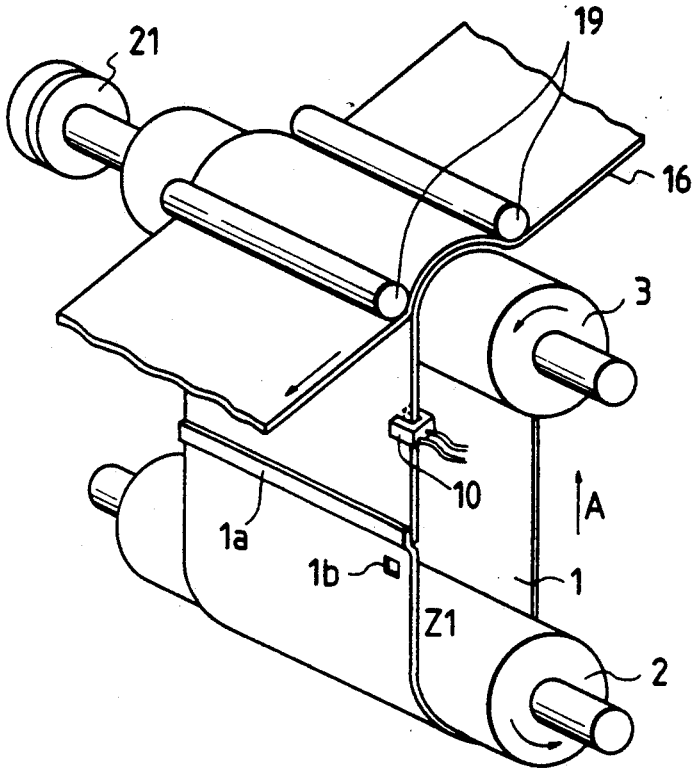
FIG. 2 is an illustration for describing a method of detecting a reference position of a photosensitive device in the FIG. 1 apparatus.

Prior to describing the embodiments of the present invention, a brief description will be made hereinbelow with reference to FIGS. 1 to 6 in terms of a conventional electrophotographic apparatus for a better understanding of this invention. In FIG. 1, illustrated at numeral 1 is a photosensitive device comprising a closed-loop like belt member or drum made of a synthetic resin or a metallic material and having on its outer surface a photosensitive film made of an organic photoconductor (OPC). This photosensitive belt 1 has a connecting portion 1*a* whereby an image-formation non-allowable region is prevented at the vicinity thereof. The image-formation allowable region is taken at the area other than the non-allowable regions and depends upon the kind of a copy sheet 24. This photosensitive belt 1 is vertically supported by two carrying rollers 2 and 3 so as to be rotationally movable by means of a drive motor, not shown, in a direction indicated by an arrow A in FIG. 1. An electrifier 4, an exposure optical system 5, developing devices 6B, 6C, 6M, 6Y (encasing a black-color (B) developer, a cyanogen-color (C) developer, a magenta-color (M) developer and a yellow-color (Y) developer, respectively), an intermediate transfer unit 7, a cleaning device 8, a charge-removing device 9 and a reference position sensor 10 are disposed in order to be in opposed relation to the outer surface of the photosensitive belt 1. The electrifier 4 is composed of a charging line 11 made of a tungsten wire, a shield plate 12 made of a metallic material and a grid plate 13 made of a metallic material. In response to a high voltage being applied to the charging line 11, a corona discharge occurs in the charging line 11 whereby the photosensitive belt 1 is evenly charged through the grid plate 13. The exposure optical system 5 generates an exposure light beam 14 including image data. In the case of a laser printer, this exposure light beam 14 is controlled by a signal from a host computer, not shown, so as to form a plurality of electrostatic latent images corresponding to predetermined color components on the photosensitive belt 1. Further, as illustrated in FIG. 2, the reference position sensor 10 is for detecting the connecting portion 1*a* of the photosensitive belt 1 and detects a reference mark such as a slit 1*b* disposed at the vicinity of the connecting portion 1*a* and at an upstream side of the photosensitive belt 1.

The respective developing devices 6B, 6C, 6M and 6Y are arranged to selectively close to and leave from the photosensitive belt 1 through cams 15B, 15C, 15M and 15Y in accordance with color selection signals from a host computer, not shown. The selected developing device (6B in FIG. 1) is operated to come into contact with the photosensitive belt 1 and the non-selected developing devices (6C, 6M and 6Y in FIG. 1) are respectively operated to be separated from the photosensitive belt 1. The intermediate transfer unit 7 includes an intermediate transfer device 16 constructed by a conductive synthetic resin or the like as a loop belt or drum which not having a connecting portion, two carrying rollers 17, 18 for movably supporting the intermediate transfer belt 16, and a transfer roller 19 disposed to be in opposed relation to the photosensitive belt 1 with respect to the intermediate transfer belt 16 to allow the transfer of the toner image from the photosensitive belt 1 to the intermediate transfer belt 16. Here, although the length L1 of the outer surface of the photosensitive belt 1 is nominally equal to the length L2 of the outer surface of the intermediate transfer belt 16, in practice the lengths L1 and L2 (i.e., the rotational periods E and F of the photosensitive belt 1 and the intermediate transfer belt 16) are arranged to be different from each other ($L1 \leqq L2$ or $L1 > L2$) when taking into account the dimensional error in manufacturing, variation with the passage of time and others. The photosensitive belt 1 and the intermediate transfer belt 16 are respectively driven by drive sources so that their peripheral speeds are constant and equal to each other.

Figure 3:
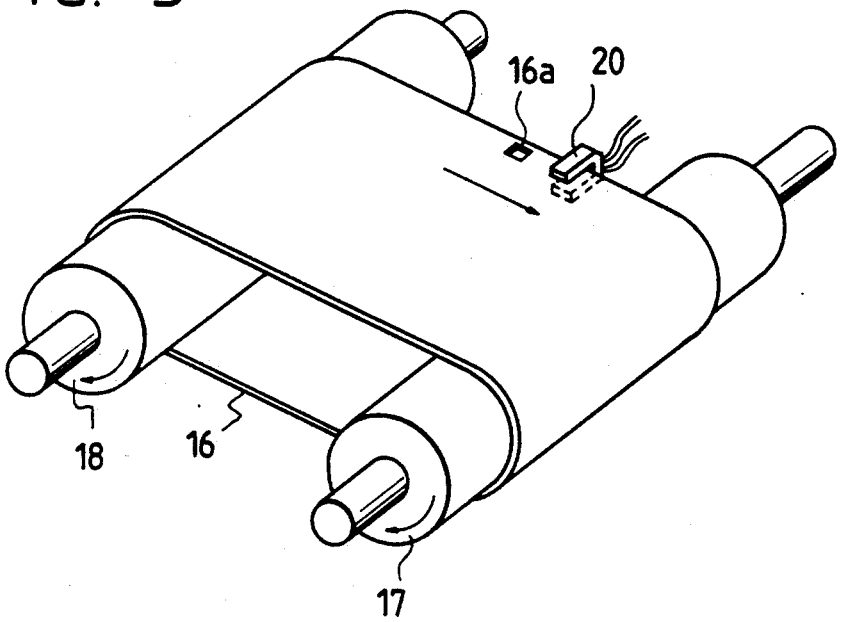
FIG. 3 is an illustration for describing a method of detecting a reference position of an intermediate transfer device in the FIG. 1 apparatus.

Numeral 20 designates a reference position sensor for detecting a reference position of the intermediate transfer belt 16. The reference position sensor 20 detects a reference mark 16*a* such as a slit formed at the vicinity of one end of the intermediate transfer belt 16 as illustrated in FIG. 3. Designated at numeral 21 in FIG. 2 is a clutch mechanism provided with respect to one of the photosensitive-belt carrying rollers 2, 3 or one of the transfer-belt carrying rollers 17, 18 for ON-OFF-controlling the rotation of the photosensitive belt 1 or the intermediate transfer belt 16 due to a drive power from a drive source, not shown. Numeral 22 is a transfer-belt cleaning device for removing the remaining toner on the intermediate transfer belt 16 after the color-combination image is transferred onto the copy sheet 24. This cleaning device 22 is separated from the intermediate transfer belt 16 before the color-combination image is transferred thereonto and is moved to come into contact with the intermediate transfer belt 16 only when cleaning. Illustrated at numeral 23 is a copy sheet cassette for encasing the copy sheets 24. The copy sheets 24 are supplied one by one through a semicircular sheet-feeding roller 25 to a copy-sheet carrying passage 26. At the vicinity of the copy-sheet carrying passage 26 there is provided a resist roller 27 for temporarily stop the copy sheet 24 so that the positions of the copy sheet 24 and the color-combination image on the intermediate transfer belt 16 are coincident with each other. The resist roller 27 takes a depressing state with respect to a non-driven roller 28. At the vicinity of the other end portion of the copy-sheet carrying passage 26 there is provided a transfer roller 29 for transferring the color-combination image on the intermediate transfer belt 16 to the copy sheet 24. The transfer roller 29 is arranged so as to come into contact with the intermediate transfer belt 16 to rotate together with the intermediate transfer belt 16 only when transferring. Designated at numeral 30 is a pressing roller 32 and a fixing device comprising a heating roller 31 having therein a heat source. The copy sheet having thereon the color-combination image is sandwiched between the pressing roller 32 and the heating roller 31 whereby the color-combination image is fixed on the copy sheet 24 by the pressure due to the pressing roller 32 and the heat due to the heating roller 31, thereby forming a color image on the copy sheet 24.

Figure 4:
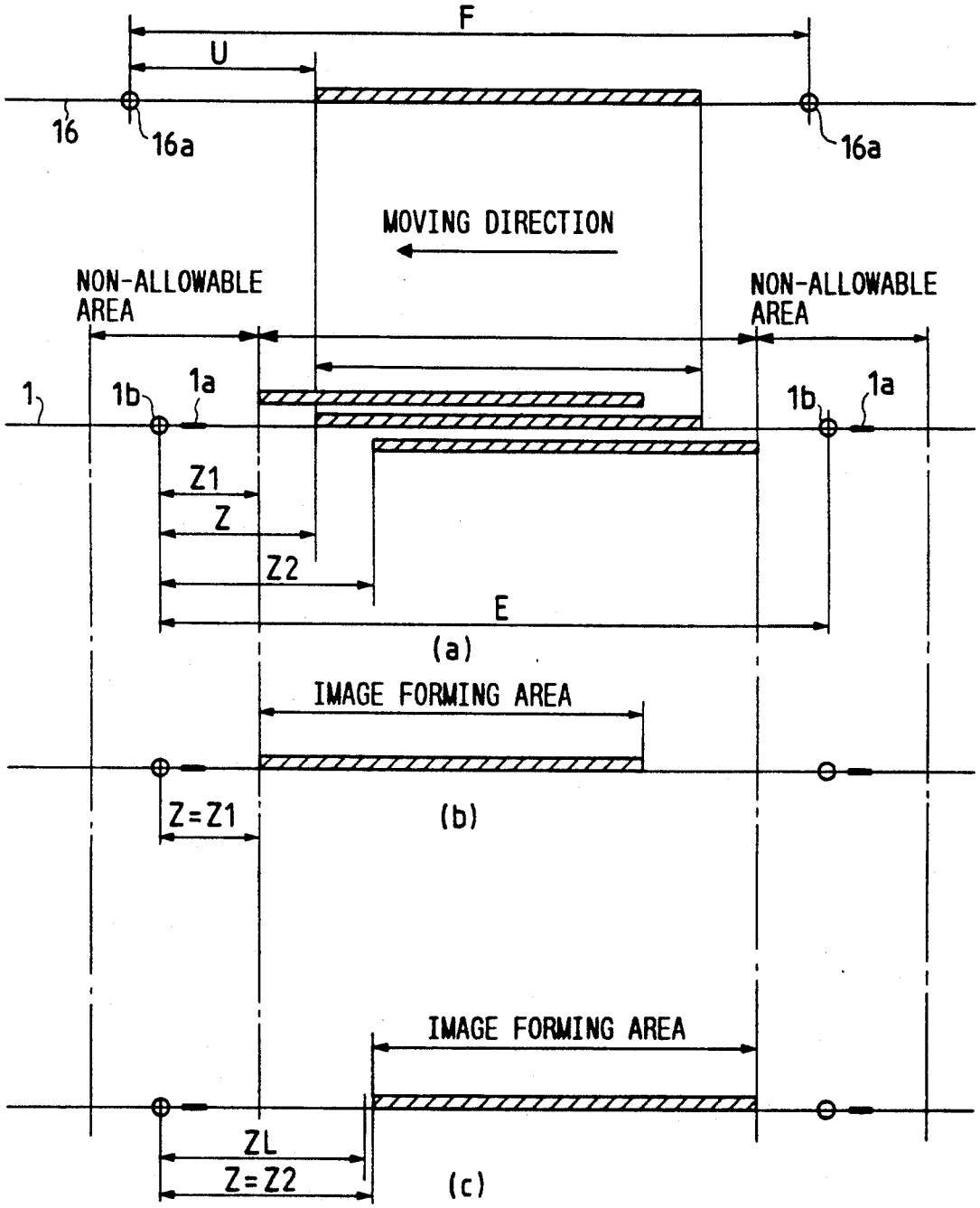
FIG. 4 PRIOR ART
FIGS. 4 to 6 are illustrations for describing an image-formation start state of a conventional electrophotographic apparatus.

In operation, in response to an image forming instruction, a high voltage is applied to the charging line 11 of the electrifier 4 so as to generate the corona discharge whereby the surface of the photosensitive belt 1 is evenly changed up to about −700 to −800 V. Thereafter, the photosensitive belt 1 is rotated in the direction of the arrow A and is illuminated with the exposure beam 14 emitted in response to an image signal (for example, a black (B) image signal), thereby forming an electrostatic latent image at the illuminated portion on the photosensitive belt 1. As shown in FIG. 4, this electrostatic latent image is formed in the image-formation allowable area (not including the connecting portion 1*a*) on the photosensitive belt 1, that is, the image formation is started when a predetermined time period U, being constant for the respective color images, is elapsed after the reference position sensor 20 detects the reference mark 16*a*. When viewed from the photosensitive belt 1 side, this image-formation is started when a predetermined time period Z is elapsed after the reference position sensor 10 detects the reference mark 1*b* as illustrated in FIG. 4. In FIG. 4, Z1 and Z2 respectively represent the time periods for allowing the start of the image formation. That is, the start of the image formation is allowed in a range until the time period Z2 elapses after the time period Z1 elapses. If the image formation is started before the time period Z1 is elapsed from the detection of the reference mark 1*b*, the image-formation position results in being in the non-allowable area, and if the image formation is started after the time period Z2 is elapsed therefrom, the image-formation terminating position results in being in the non-allowable area, thereby deteriorating the image quality. Thus, when viewed from the intermediate transfer belt 16, the image-formation start time period after the reference position sensor 20 detects the reference mark 16*a* is required to be set to be a time period which is longer than the time period Z1 and shorter than the time period Z2.

On the other hand, for example, the developing device 6B is pressed in the direction indicated by an arrow D through the cam 15B driven in accordance with the color selection signal so as to be brought into contact with the photosensitive belt 1. Accompanying with this contact with the photosensitive belt 1, the black toner is attached to the electrostatic latent image formed on the photosensitive belt 1, thereby forming a black toner image. In response to the completion of the development, the developing device 6B is moved up to the separated position due to the rotation of the cam 15B. The toner image formed on the photosensitive belt 1 is transferred onto the intermediate transfer belt 16 with a high voltage being applied to the transfer roller 19 disposed to come into contact with the photosensitive belt 1. After transferred, the remaining toner is removed by the cleaning device 8 and the charge on the photosensitive belt 1 is then removed by the charge-removing device 9.

Secondly, when the C-color is selected, an image formation on the photosensitive belt 1 is started when the time period U is elapsed after the reference position sensor 20 detects the reference mark 16*a* to form an electrostatic latent image on the photosensitive belt. Simultaneously with this latent image formation, the cam 15C is rotated so that the developing device 6C is pressed toward the photosensitive belt 1 to come into contact therewith to then start the C-color development. In the case of a 4-color copying machine or printer, the above-described image forming operation is repeatedly performed 4 times and the B-, C-, M- and Y-color toner images are overlapped so as to form a color-combination image on the intermediate transfer belt 16. After the completion of the formation of the color-combination image, the transfer roller 29 is brought into contact with the intermediate transfer belt 16 and rotated as it is and a high voltage is applied to the transfer roller 29, whereby the color-combination image on the intermediate transfer belt 16 is integrally transferred onto the copy sheet 24 supplied through the carrying passage 26. Subsequently, the copy sheet 24 having thereon the toner color-combination image is fed to the fixing device 30 so as to form a color image thereon by the heat due to the heating roller 31 and the pressure due to the pressing roller 32. The remaining toner on the intermediate transfer belt 16 is removed by means of the cleaning device 22. The cleaning device 22 is separated from the intermediate transfer belt 16 until the first color-combination image is formed, and after the color-combination image is transferred onto the copy sheet 24 through the transfer roller 29, the cleaning device 22 is brought into contact with the intermediate transfer belt 16.

In these consecutive image forming operations, as described above, the resultant images come loose on the intermediate transfer belt 16 if the image formation is not started when the predetermined time period U is elapsed after the reference position sensor 20 detects the reference mark 16*a*. However, since there is a difference in period always between the photosensitive belt 1 and the intermediate transfer belt 16, when continuing to perform the image formation operation, in the case that one period (E) of the photosensitive belt 1 is longer than one period (F) of the intermediate transfer belt 16 ((*b*) in FIG. 4), the image-formation start position enters into the non-allowable area of the photosensitive belt 1, and in the case that one period (E) of the photosensitive belt 1 is shorter than one period (F) of the intermediate transfer belt 16 ((*c*) in FIG. 4), the image-formation terminating position enters into the non-allowable area thereof. Thus, it is required to control the image-formation start position.

Figure 5:
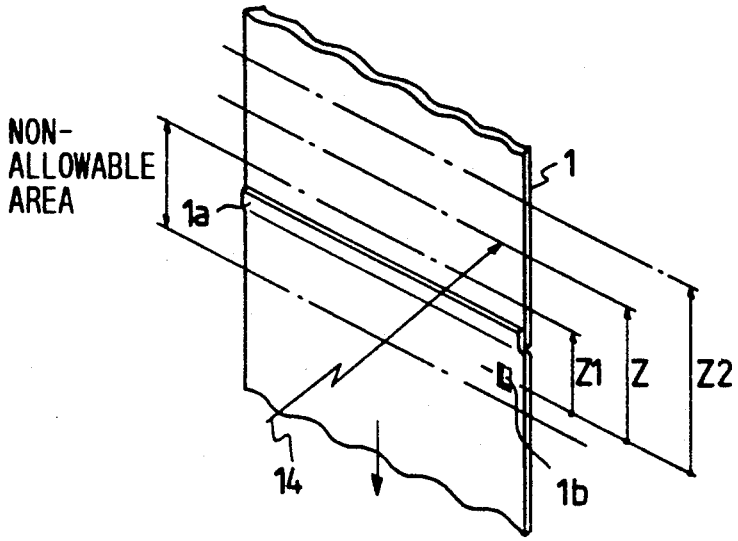
FIG. 5 PRIOR ART
Figure 6:
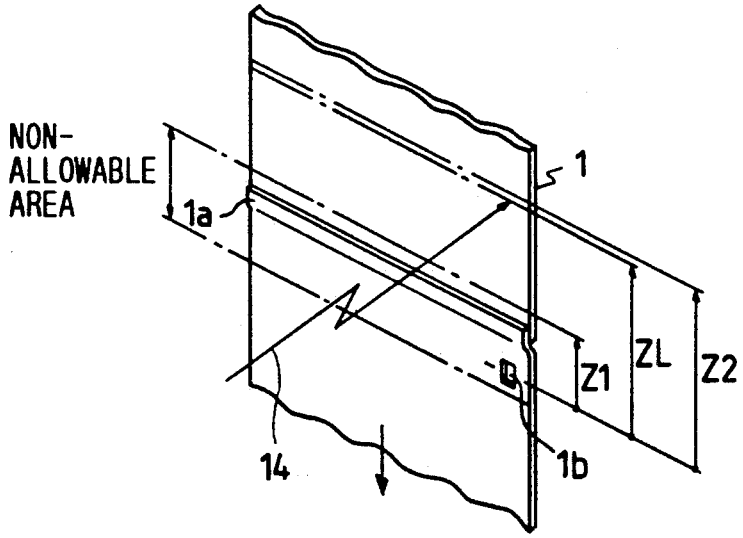
FIG. 6 PRIOR ART

A description will be made hereinbelow with reference to FIGS. 4 to 6 in terms of a conventional image-formation start position control in the case that the period of the photosensitive belt 1 is shorter than the period of the intermediate transfer belt 16. The first image is formed in the image-formation allowable area after the predetermined formation start time period U is elapsed from the detection of the reference mark 16*b* as illustrated in FIGS. 4(*a*) and 5. When viewed from the photosensitive belt 1 side, this formation start position appears when the time period Z is elapsed after the reference position sensor 10 detects the reference mark 1*b*. When continuing the image forming operation, in the nth image formation, as shown in FIGS. FIG. 4(*c*) and 6, because of the difference in period between the photosensitive belt 1 and the intermediate transfer belt 16, the image-formation start position is gradually shifted on the photosensitive belt 1, and when viewed from the photosensitive belt 1 side, the image-formation start position is taken when a time period ZL is elapsed from the detection of the reference mark 1*b*, that is, it is closed to the position corresponding to the time period Z2 so as to finally enter into the non-allowable area. Accordingly, the power to the carrying roller 3 is required to be cut for a predetermined time period by means of the clutch mechanism 21 provided with respect to the drive shaft of the carrying roller 3 so as to reduce the rotational speed of the photosensitive belt 1 or stop the rotation thereof, thereby adjusting the image-formation start position.

However, the above-described arrangement does not allow a fine adjustment at every color image for a time shorter than the response time of the clutch mechanism and does not permit accurate alignment at every color image in correspondence with the variation with the passage of time. In addition, in the case that there is the possibility that the image-formation start position or the image-formation terminating position enters into the non-allowable area, since the positional adjustment is made with the image-formation operation being stopped, a time is required for the alignment in reference position between the photosensitive belt 1 and the intermediate transfer belt 16, thereby decreasing the image-formation speed. Moreover, a complicated mechanism such as the clutch mechanism 21 for the positional adjustment between the photosensitive belt 1 and the intermediate transfer belt 16 is required whereby the manufacturing cost considerably heightens. Furthermore, the photosensitive belt 1 and the intermediate transfer belt 16 are rubbed against each other in the positional adjustment so as to be damaged, thereby resulting in deteriorating the image quality.

Figure 7:
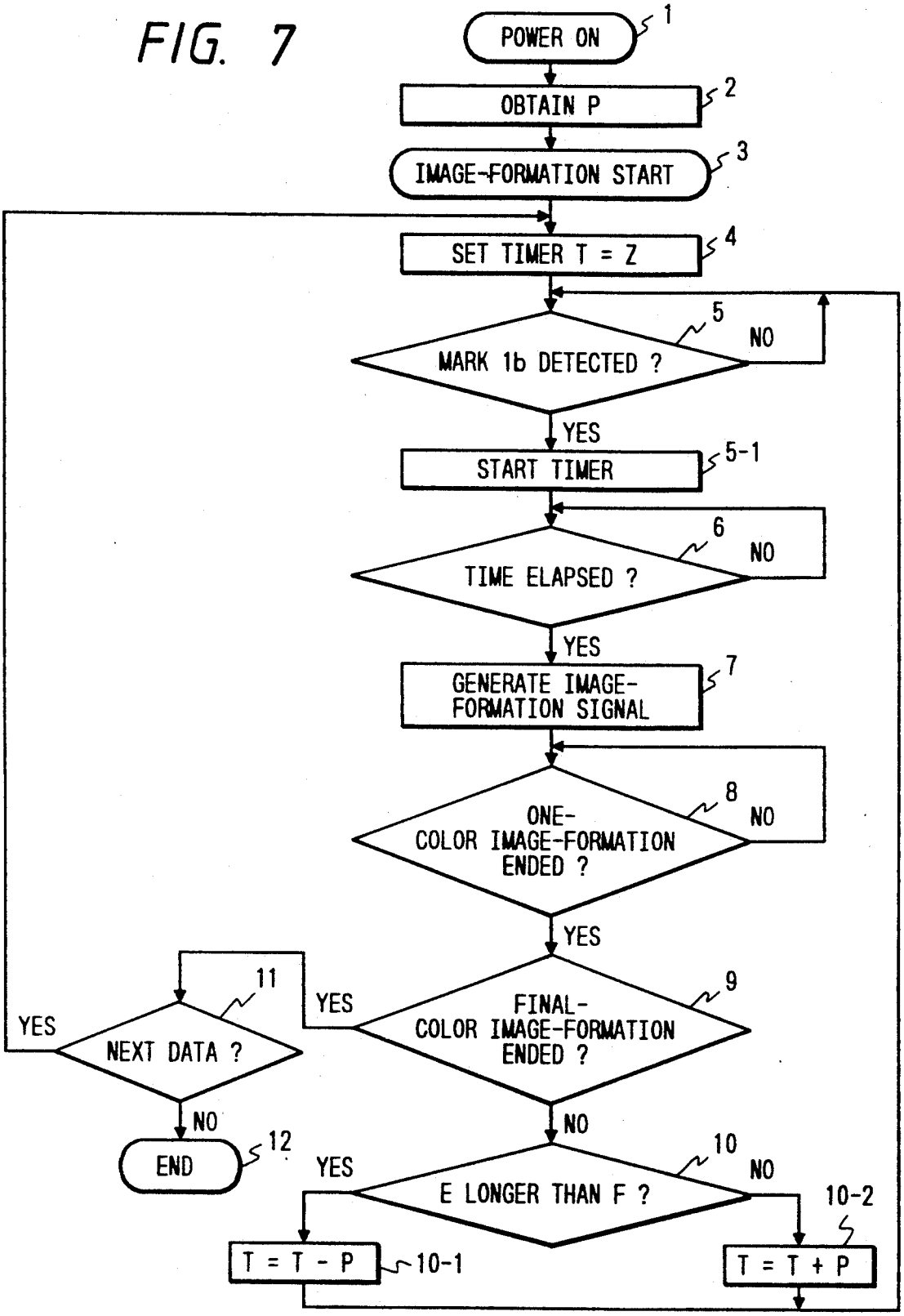
FIG. 7 is a flow chart showing an operation of an electrophotographic apparatus according to a first embodiment of the present invention.

Now, a description will be made hereinbelow with reference to FIGS. 1 and 7 to 12 in terms of an image-formation start control operation of an electrophotographic apparatus according to a first embodiment of the present invention, this electrophotographic apparatus having the same structure as shown in FIG. 1. FIG. 7 is a flow chart for describing an operation of the first embodiment which is principally performed by an electronic control unit (i.e., a CPU 102 in FIG. 12). In FIG.

Figure 12:
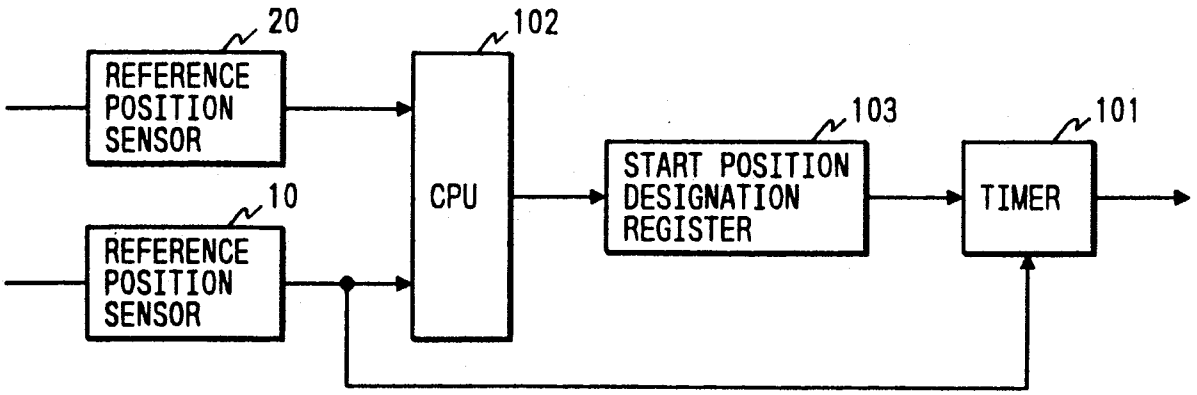
FIG. 12 is a block diagram showing an arrangement for the image-formation start timing control in the first embodiment of this invention.

7, in response to turning-ON of a power source of the apparatus, prior to the image formation, a step 2 is first executed so as to calculate a period difference P ($=|E-F|$) between the photosensitive belt 1 and the intermediate transfer belt 16. That is, as illustrated in FIG. 12, the photosensitive-belt reference position sensor 10 detects the reference mark 1*b* in order to measure one period (E) of the photosensitive belt 1 and the intermediate-transfer-belt reference position sensor 20 whereby a central processing unit 102 calculates the period difference P. A subsequent step 3 is for generating an image-formation start signal for formation of a color image. In response to the generation of the start signal in the step 3, a first-page image formation is started with a step 104. The step 104 is for setting a predetermined initial image-formation start time period Z to a timer 101 (FIG. 12). This means that, when the predetermined initial image-formation start time period Z is elapsed after the reference position sensor 10 detects the reference mark 1*b* of the photosensitive belt 1, an image-formation signal corresponding to a first color (for example, black) is generated so that the photosensitive belt 1 is exposed to the exposure light beam 14. As described with reference to FIG. 4, this initial image-formation start time period Z is determined to be longer than the time period Z1 and shorter than the time period Z2 to thereby prevent the image-formation start position and the image-formation terminating position from entering into the image-formation non-allowable area of the photosensitive belt 1. Here, the period difference P is arranged to be set to an extremely short time period as compared with the initial image-formation start time period Z whereby the area for the formation of the final color (for example, Yellow) image is not overlapped with the image-formation non-allowable area of the photosensitive belt 1.

Thereafter, when in a step 5 the reference position sensor 10 detects the reference mark 1*b* and outputs a reference position signal indicative of the detection of the reference mark 1*b*, a step 5-1 follows to start the timer 101, then followed by a step 6 to check, in accordance with the timer 101, whether the predetermined initial image-formation time period Z is elapsed from the detection of the reference mark 1*b*. If so, a step 7 is then executed in order to generate a first image-formation signal (for example, the black-color image-formation signal), whereby the exposure light beam 14 corresponding to the black image-formation signal is emitted so that an electrostatic latent image is formed on the photosensitive belt 1, and a black toner image is formed with the latent image on the photosensitive belt 1 being processed by the black developing device 6B. The black toner image formed on the photosensitive belt 1 is transferred onto the intermediate transfer belt 16 when a predetermined time period Q is elapsed after the reference position sensor 20 detects the reference mark 16*a* of the intermediate transfer belt 16.

Figure 9:
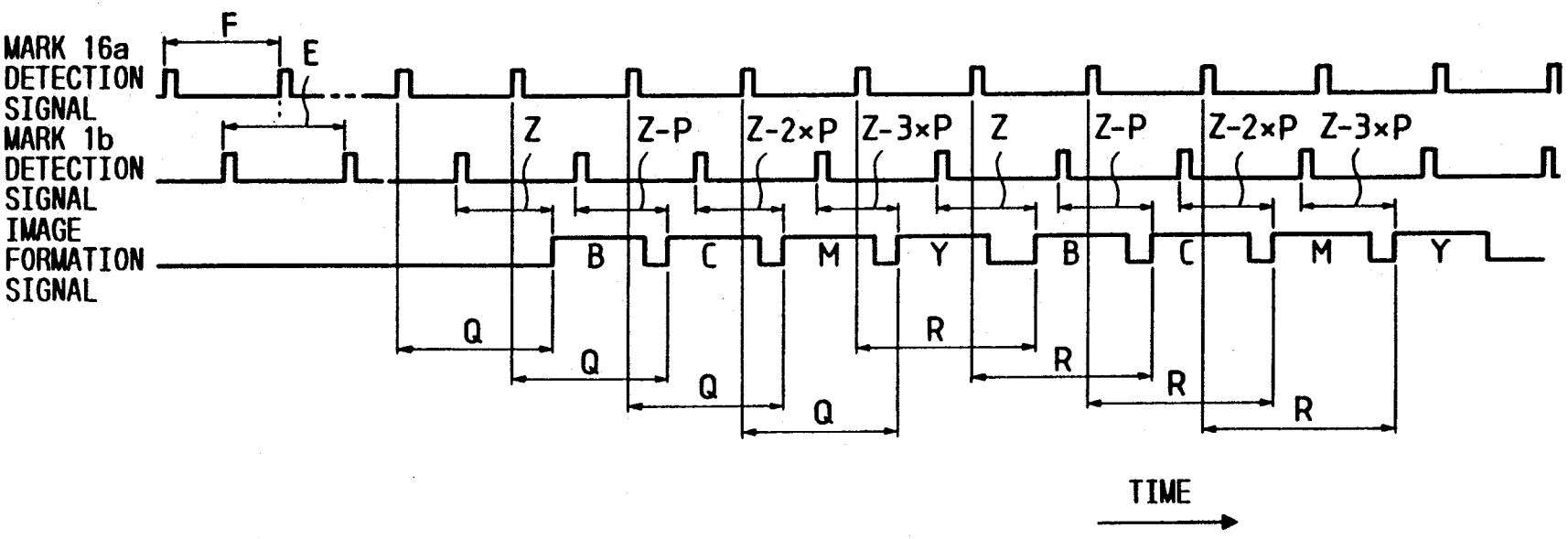

A step 8 is for checking whether the process for one-color image formation is completed. If so, a step 9 follows to check whether the previous process is the final-color image-formation process. If the answer of the step 9 is negative, prior to the next image-formation process, the operational flow goes to a step 10 to perform the comparison between the period (E) of the photosensitive belt 1 and the period (F) of the intermediate transfer belt 16 previously obtained in the above-described step 2. If the period (E) of the photosensitive belt 1 is longer than the period (F) of the intermediate transfer belt 16, a step 10-1 is executed such that the difference [Z−P] between the predetermined initial image-formation start time period Z and the period difference P is inputted and stored as a corrected image-formation start time period into a start position designation register 103 illustrated in FIG. 12. On the other hand, if the period (E) is shorter than the period (F), the sum [Z+P] between the initial image-formation start time period Z and the period difference P is inputted and stored as the corrected image-formation start time period into the same start position designation register 103. Thereafter, the next image-formation process (for example, C-color image-formation process) is started in accordance with the corrected image-formation start time period stored in the start position designation register 103 and then set to the timer 101. That is, for example, in the case that the period (E) of the photosensitive belt 1 is longer than the period (F) of the intermediate transfer belt 16, after the C-color image-formation start time period is corrected to [Z−P], the operational flow returns to the above-described step 5 to check whether the reference position sensor 10 detects the reference mark 1*b*. If so, in the step 5-1 the timer 101 starts in response to the detection signal from the reference position sensor 10, and in the step 7 an image-formation signal is outputted after the time period [Z−P] is elapsed as shown in FIGS. 8A and 9, thereby producing a C-color toner image on the photosensitive belt 1. The C-color toner image is accurately transferred onto the black toner image, previously formed on the intermediate transfer belt 16, one upon another at the time of elapse of the time period Q after the reference position sensor 20 detects the reference mark 16*a*. Thereafter, as shown in FIGS. 8A and 9, the subsequent M-color and Y-color image formations are respectively effected after the elapses of a [Z−2×P] time period and a [Z−3×P] time period from the detection of the reference mark 1*b*. When the final-color image formation process (for example, Y-color image formation) is completed, that is, when the answer of the step 9 is affirmative, the color combination image transferred onto the intermediate transfer belt 16 is transferred onto the copy sheet 24 and fixed by the fixing device 30 so as to produce a first-page color image on the copy sheet 24. Further, the operational flow advances from the step 9 to a step 11 to check whether there is a requirement (data) for a second-page image formation. If the answer of the step 11 is "YES", the operational flow returns to the step 4. On the other hand, if not, the operational flow proceeds to a step 12 to terminate this image-formation operation.

Secondly, an operation for the second-page color image formation will be described hereinbelow with reference to FIGS. 8B and 9. Prior to the second-page color image formation, since the image-formation start time period is now set to ]Z−3×P] taken for the final-color (Y-color) image formation, the image-formation start time period is restored to Z for the first-color (black-color) image formation and set to the timer 101 (step 4). When the reference position sensor 10 detects the reference mark 1*b* (step 5), the timer 101 starts in response to the reference detection signal therefrom (step 5-1). After elapse of the time period Z (step 6), the first-color image formation signal is outputted (step 7) whereby the corresponding exposure light beam 14 is emitted toward the photosensitive belt 1 so as to produce an electrostatic latent image. The developing device 6B produces a first-color (black-color) toner image on the basis of the produced electrostatic latent image.

The toner image produced on the photosensitive belt 1 is transferred onto the intermediate transfer belt 16 when a predetermined time period R is elapsed after the reference position sensor 20 detects the reference mark 16*a*.

If this image-formation operation is not effected in accordance with the final-color image-formation signal (step 9), the operational flow advances to the next color (C-color) image formation process. Prior to the next color image formation, the difference [Z−P] between the initial image-formation start time period Z and the period difference P is set as the corrected image-formation start time period for the next color image formation to the start position designation register 103 and then set to the timer 101. Thus, a similar operation is effected for the next color image formation on the basis of the corrected image-formation start time period [Z−P]. For the third- and final-color image formations, [Z−2×P] and [Z−3×P] are respectively taken as the image-formation start time periods. Since according to this image-formation start time period control operation the image-formation start time period returns to the original time period (Z), the image-formation operation can continuously be performed without overlapping between the image-formation area and the image-formation non-allowable area.

Figure 11:
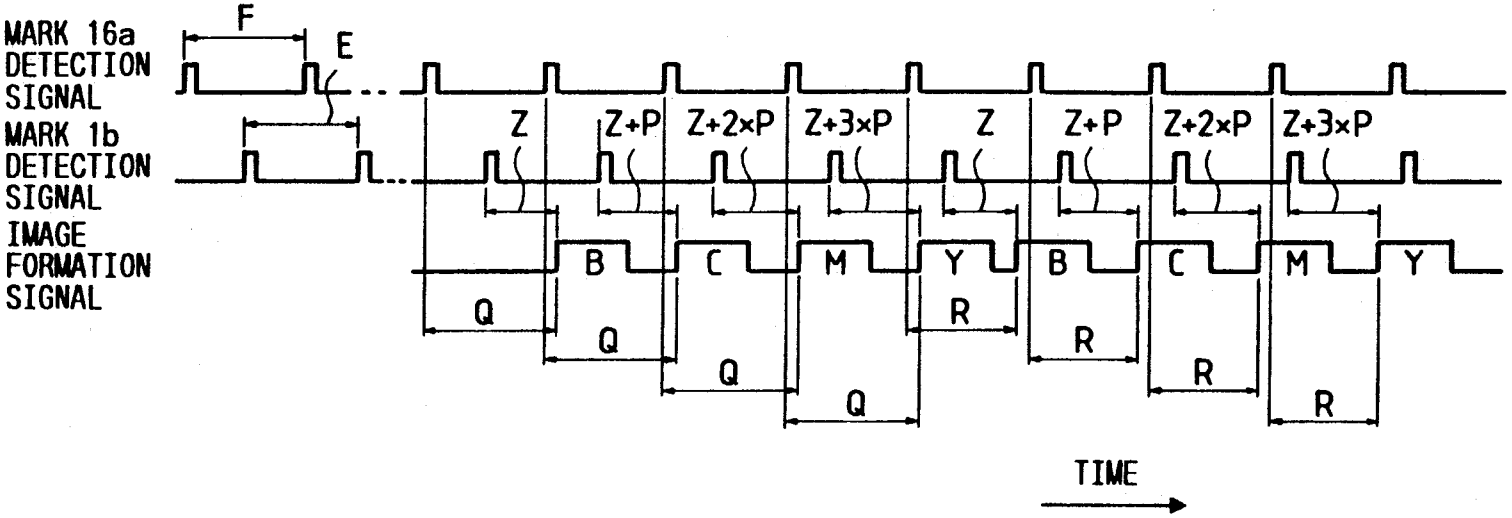

On the other hand, in the case that the period (E) of a photosensitive belt 1 is shorter than the period (F) of an intermediate transfer belt 16, the image-formation start position control operation is executed as illustrated in FIGS. 10A, 10B and 11. Here, the period difference P is successively added to the initial image-formation start time period Z.

Figure 14:
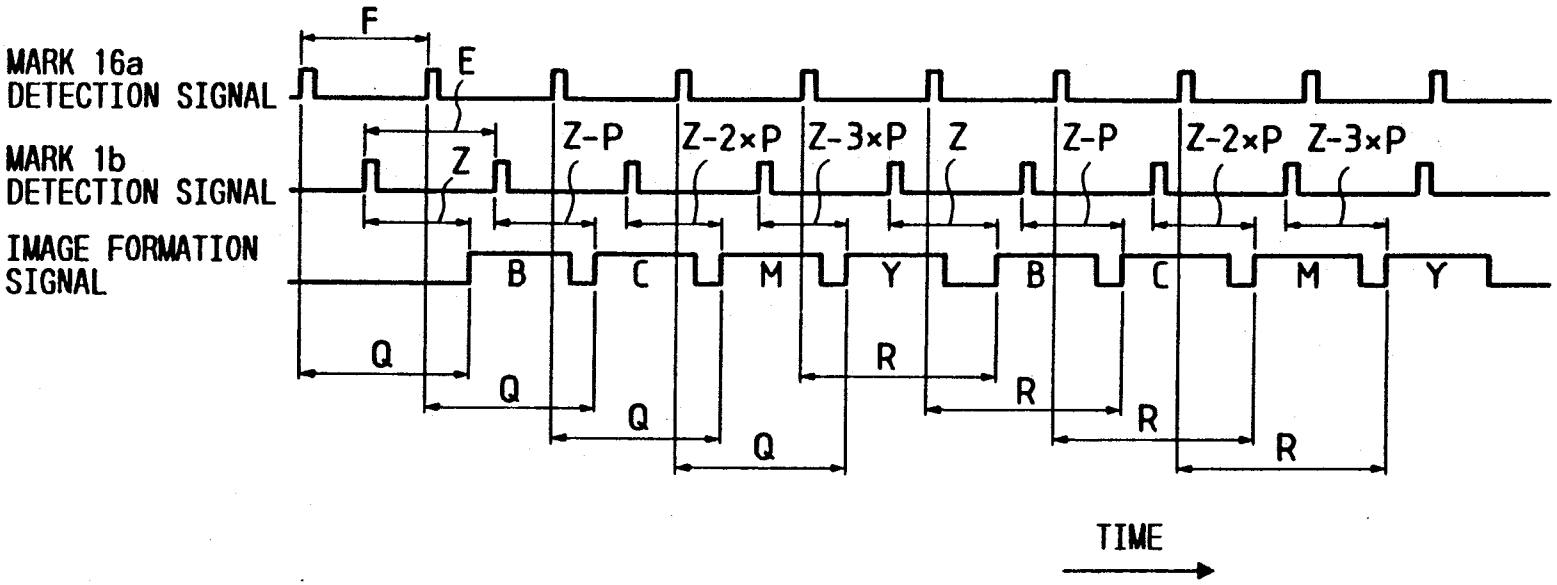
FIG. 14 is an illustration of the image-formation start timings of the FIG. 13 apparatus in the case that the period of the photosensitive device is longer than the period of the intermediate transfer device.
Figure 15:
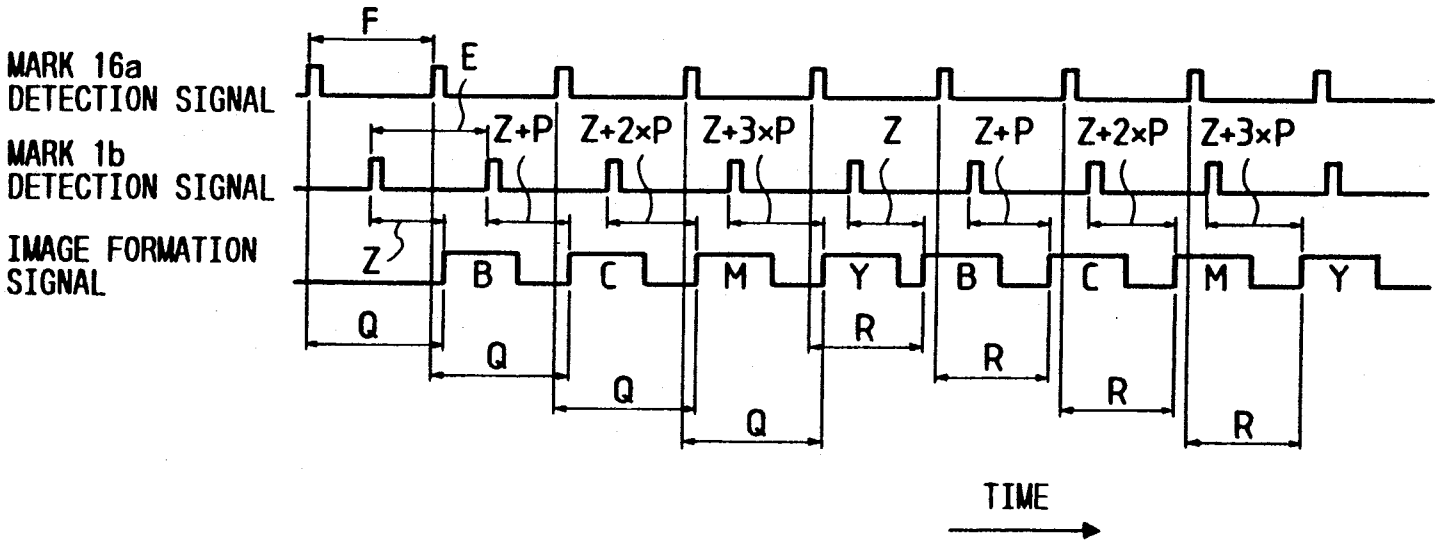
FIG. 15 is an illustration of the image-formation start timings of the FIG. 13 apparatus in the case that the period of the photosensitive device is shorter than the period of the intermediate transfer device.

Further, a description will be made hereinbelow with reference to FIGS. 13 to 15 in terms of an image-formation start timing control operation of an electrophotographic apparatus according to a second embodiment of this invention. Although the above-described first embodiment previously measures the period (E) of the photosensitive belt 1 and the period (F) of the intermediate transfer belt 16 so as to calculate the period difference P [=|E−F|] therebetween before the first-color image formation process, the second embodiment measures the period (E) of the photosensitive belt 1 and the period (F) of the intermediate transfer belt 16 so as to calculate the period difference P [=|E−F|] therebetween during or after the first-color image formation process for the first-page color-combination image, thereafter correcting the image-formation start time period on the basis of the period difference P. That is, in FIG. 13, the process corresponding to the step 2 in FIG. 7 is removed from the image-formation operation and steps 8-1 and 8-2 are newly added thereto. Steps corresponding to those in FIG. 7 are marked with the same numerals and the description will be omitted for brevity. The step 8-1 is for checking whether the image formed in the step 8 is the first-color image for the first-page color-combination image. If so, the step 8-2 follows to obtain the period difference P between the period (E) of the photosensitive belt 1 and the period (F) of the intermediate transfer belt 16. FIG. 14 is an illustration of the image-formation start timings in the case that the period (E) of the photosensitive belt 1 is longer than the period (F) of the intermediate transfer belt 16, and FIG. 15 is an illustration of the image-formation start timings in the case that the period (E) of the photosensitive belt 1 is shorter than the period (F) of the intermediate transfer belt 16.

A description will be made hereinbelow with reference to FIGS. 16 to 20 in terms of an electrophotographic apparatus according to a third embodiment of this invention. Although in the aforementioned second embodiment the period difference P is calculated during the first-color image formation process so as to determine the image-formation start timings for the subsequent color image formation processes on the basis of the calculated period difference P, in the third embodiment the period difference P is calculated during the first-color image formation process at every page so as to determine the start timings for the subsequent image formation processes for the same-page color-combination image on the basis of the calculated period difference P.

Figure 13:
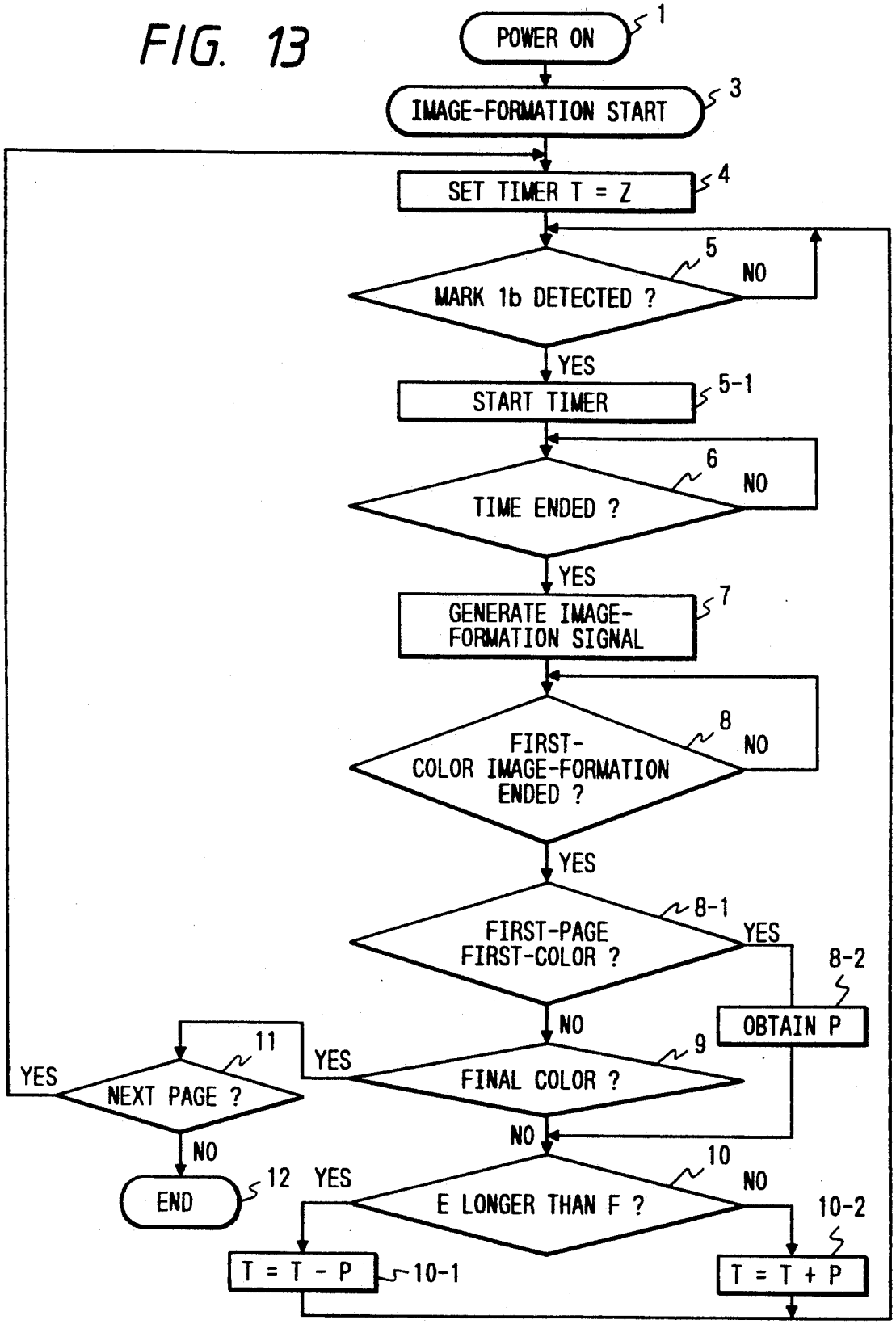
FIG. 13 is a flow chart showing an image-formation operation of an electrophotographic apparatus according to a second embodiment of this invention.
Figure 16:
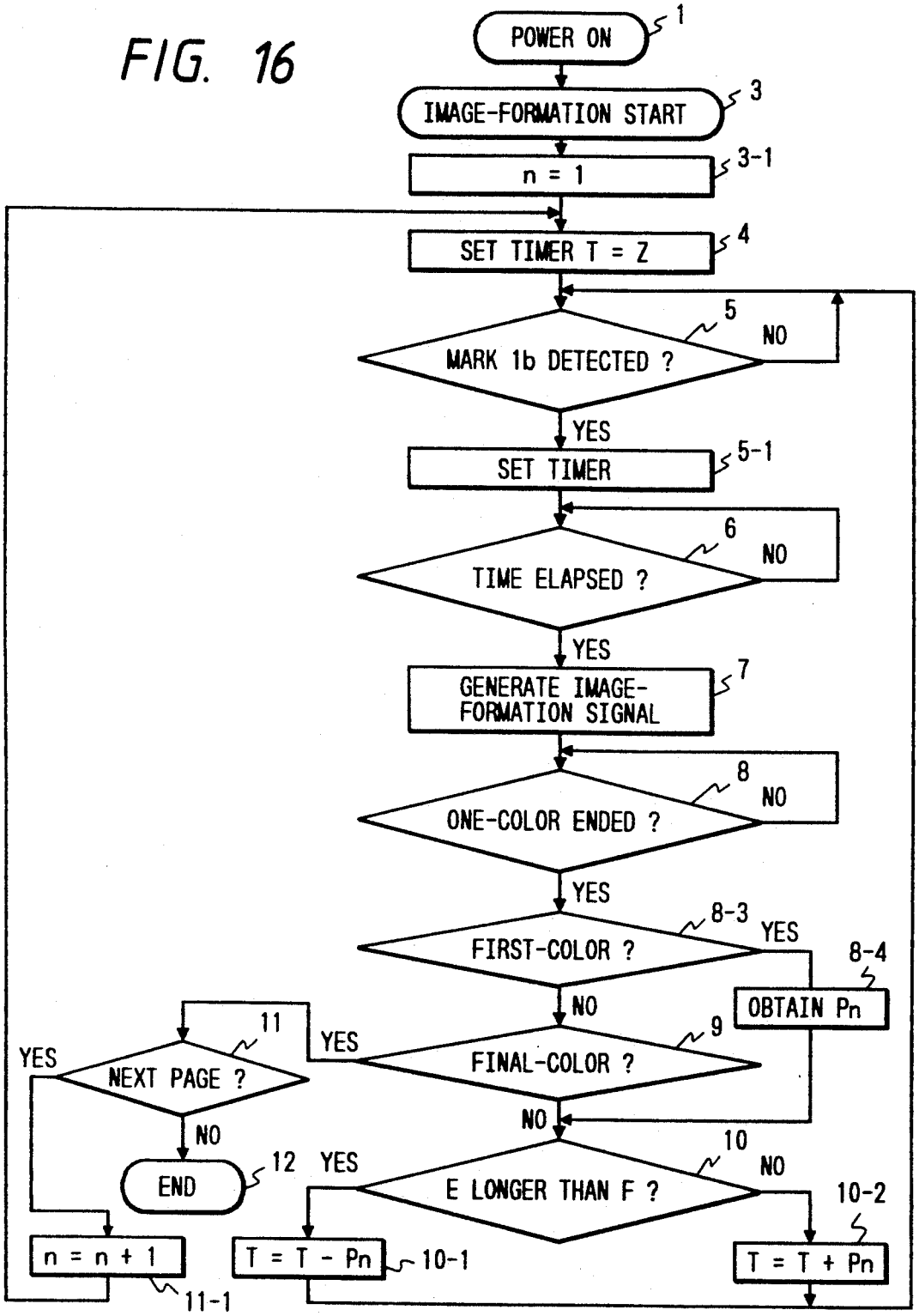
FIG. 16 is a flow chart showing an image-formation operation of an electrophotographic apparatus according to a third embodiment of this invention.

FIG. 16 is a flow chart showing an image-formation start timing control operation of the apparatus of the third embodiment of this invention, where steps corresponding to those in FIG. 13 are marked with the same numerals and the description will be omitted for brevity. In FIG. 16, a step 3-1 is for setting the page number n (the number of the color-combination images to be transferred through the intermediate transfer belt 16 onto the copy sheet 24). Here, the number (variable) n is set to 1 indicative of the first page. After the executions of the steps 4 to 8, a step 8-3 is then executed so as to check whether the image-formation signal is for the first color image. If the answer of the step 8-3 is "YES", a step 8-4 follows to calculate the period difference Pn (here, P1 indicative of the period difference in the case of the first-page color image formation), thereafter advancing to a step 10 to perform the comparison between the period (E) of the photosensitive belt 1 and the period (F) of the intermediate transfer belt 16, thereby performing the image-formation start timing control for the subsequent image formation processes for the same page on the basis of the period difference Pn in accordance with the comparison result in the step 10. On the other hand, if the answer of the step 8-3 is "NO", the operational flow proceeds to a step 9 to check whether or not the image-formation signal is for the final-color image. If affirmative, the operational flow goes to the steps 10 and 10-1 or 10-2. If negative, a step 11 follows to check whether or not there is need (data) for the next page. If the answer of the step 11 is "YES", a step 11-1 follows so as to increment the variable n by 1, i.e., set the variable n to 2 indicative of the second page, thereafter returning to the step 4.

Figure 18:
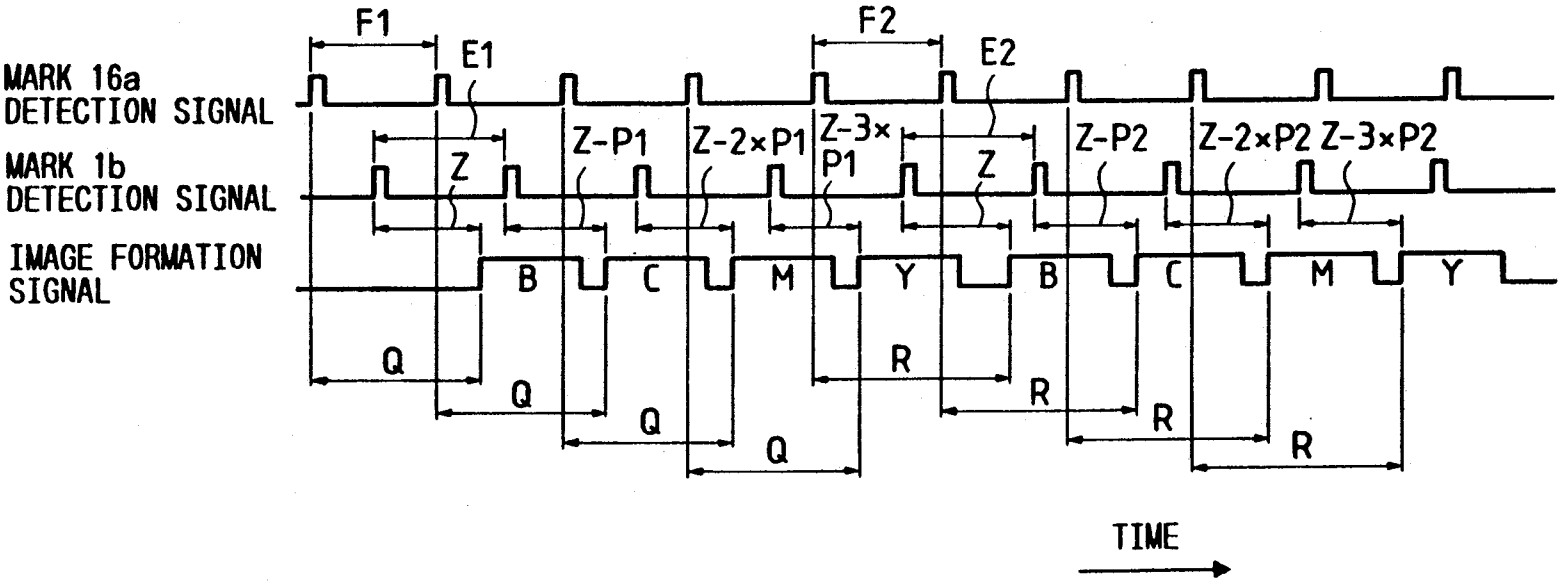
Figure 20:
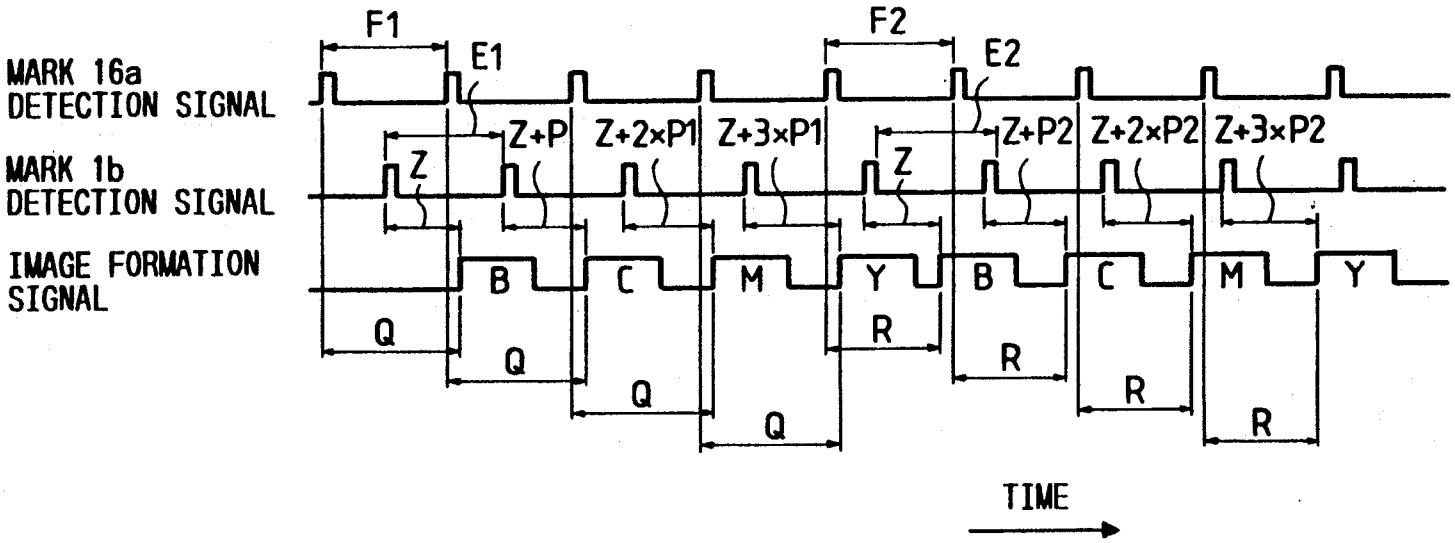

FIGS. 17A, 17B and 18 are illustrations of the image-formation start timing control of the above-described third embodiment of this invention in the case that the period (E) of the photosensitive belt 1 is longer than the period (F) of the intermediate transfer belt 16, and FIGS. 19A, 19B and 20 are illustrations of the image-formation start timing control of the third embodiment in the case that the period (E) of the photosensitive belt 1 is shorter than the period (F) of the intermediate transfer belt 16. In FIGS. 17A to 20, E1 represents the period of the photosensitive belt 1 in the case of the formation of the first-page color-combination image and F1 designates the period of the intermediate transfer belt 16 in the same case.

Figure 21:
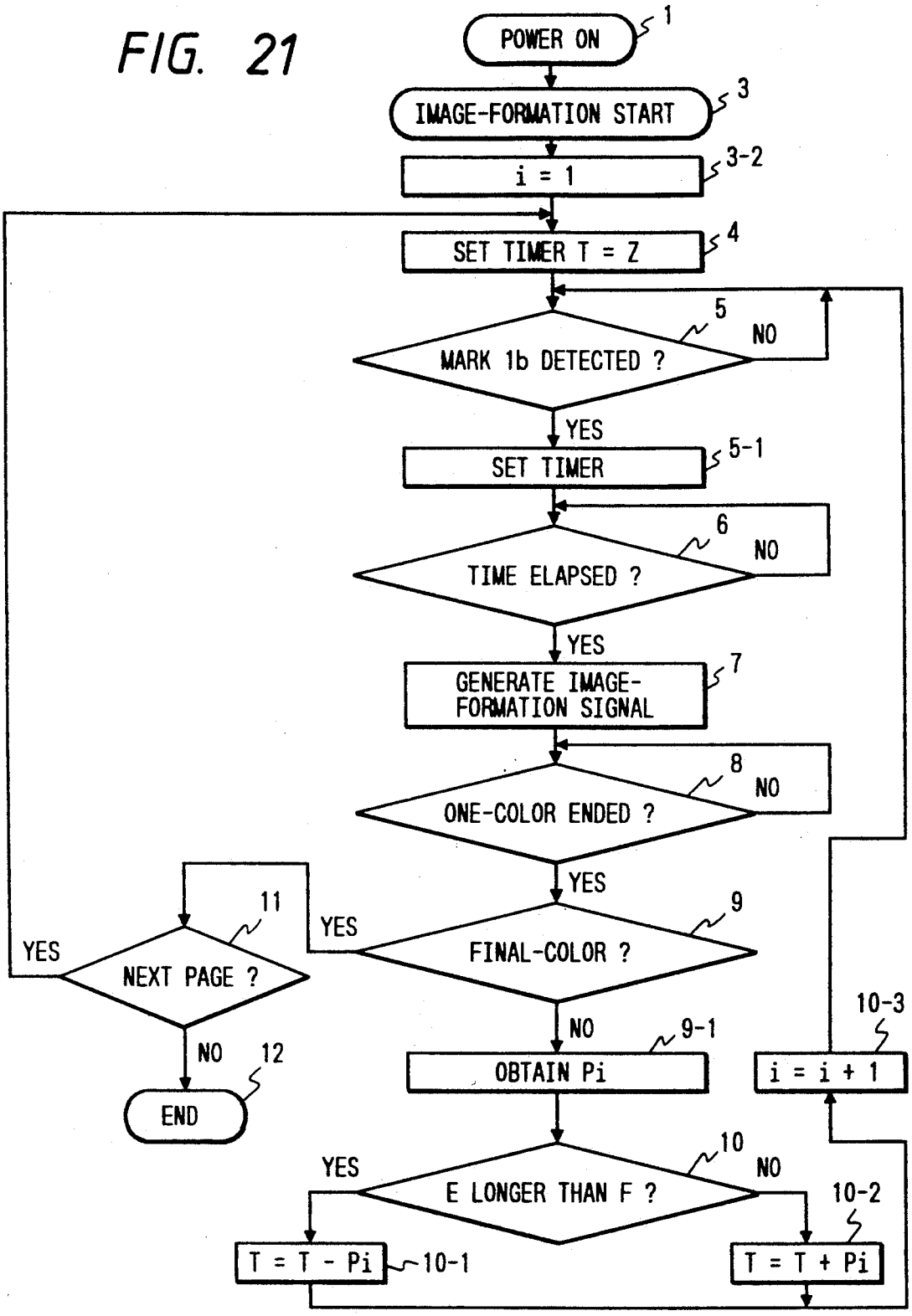
FIG. 21 is a flow chart showing an image-formation operation of an electrophotographic apparatus according to a fourth embodiment of this invention.
Figure 23:
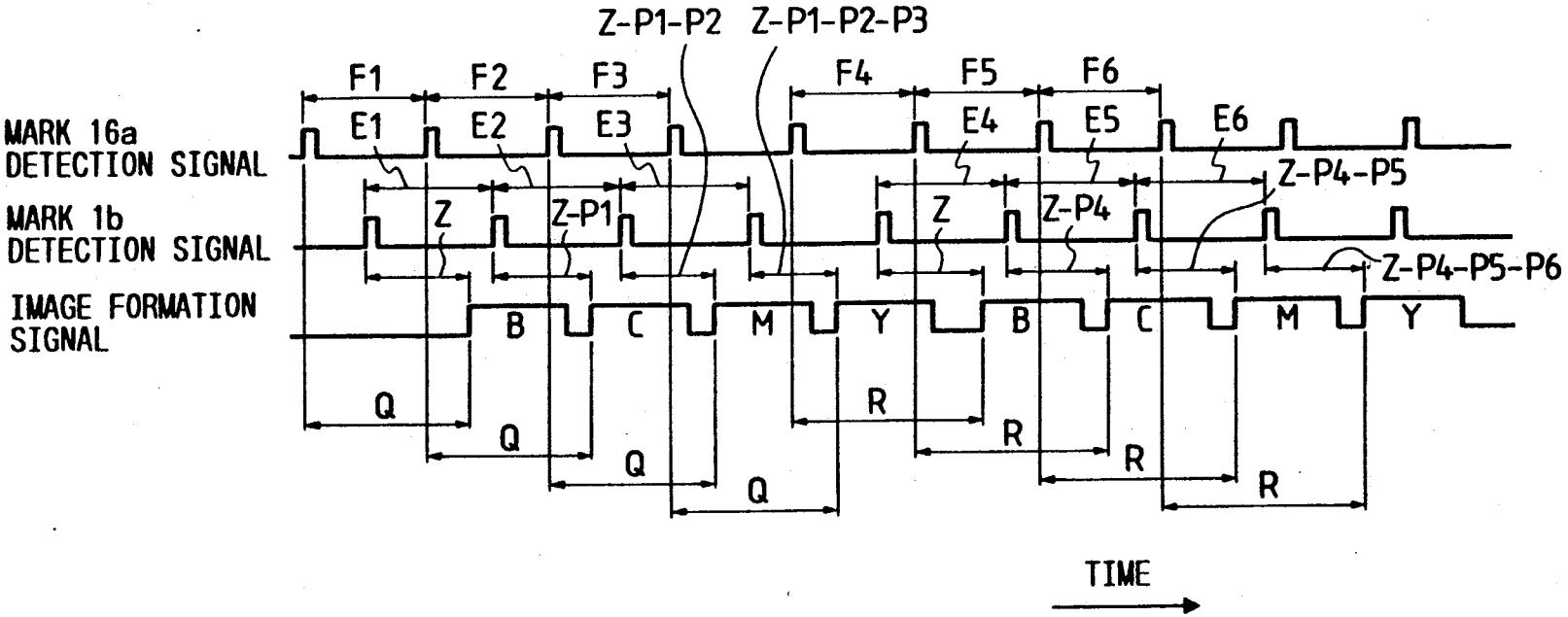
Figure 25:
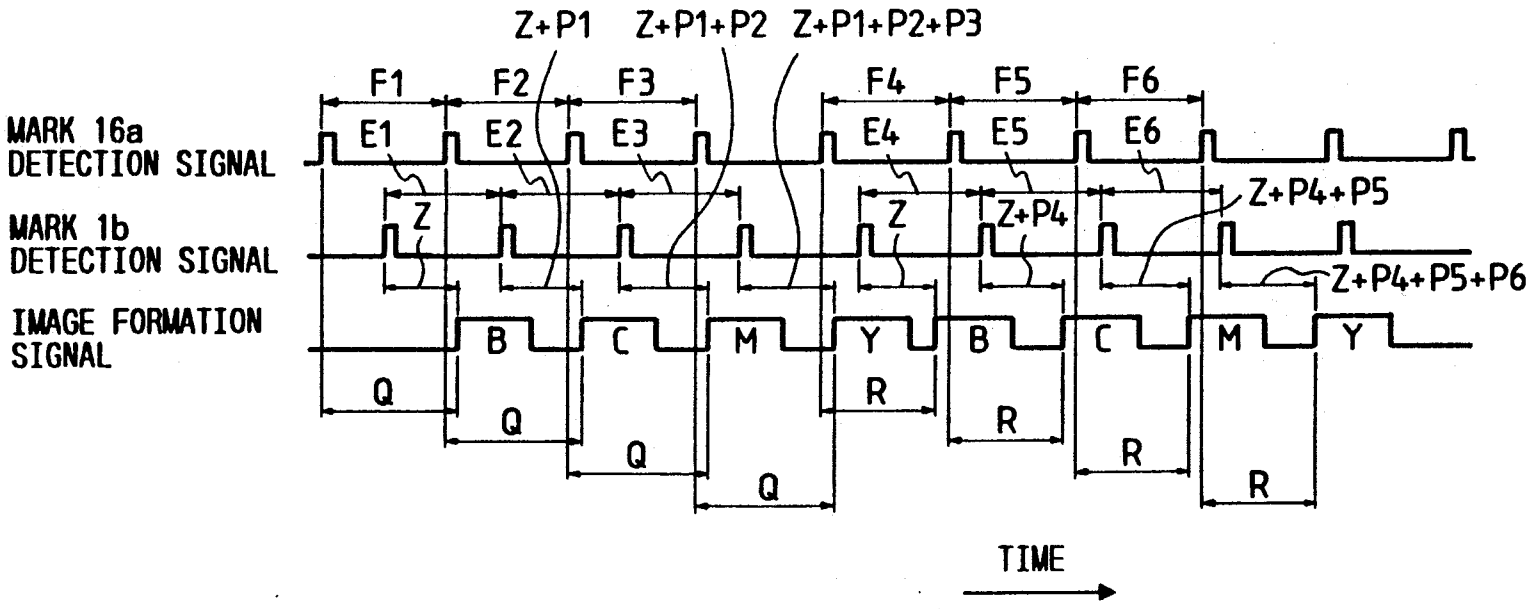

Furthermore, a fourth embodiment of this invention will be described hereinbelow with reference to FIGS. 21 to 25. FIG. 21 is a flow chart showing an image-formation operation of an electrophotographic apparatus according to the fourth embodiment of this invention, where steps corresponding to those in the above-described embodiments are marked with the same numerals and the description thereof will be omitted. In FIG. 21, after the execution of the step 3, a step 3-2 follows to set a variable i to 1 at the initial stage. After the executions of the steps 4 to 8, if the answer of the step 9 is "NO", a step 9-1 is executed so as to calculate the period difference Pi between the period (E) of the photosensitive belt 1 and the period (F) of the intermediate transfer belt 16. After the execution of the step 9-1, operational flow goes through the steps 10 and 10-1 or 10-2 to a step 10-3 to increment the variable i by one and then returns to the step 5. According to this fourth embodiment, the period difference P between the photosensitive belt 1 and the intermediate transfer belt 16 is calculated and corrected at every color image formation for each page, and therefore, it is possible to cope with the passage of time or the like so as to further improve the image quality. FIGS. 22A, 22B and 23 are illustrations of the image-formation start timing control operation of the electrophotographic apparatus of the fourth embodiment in the case that the period (E) of the photosensitive belt 1 is longer than the period (F) of the intermediate transfer belt 16, and FIGS. 24A, 24B and 25 are illustrations of the image-formation start timing control operation thereof in the case that the period (E) of the photosensitive belt 1 is shorter than the period (F) of the intermediate transfer belt 16.

Figure 26:
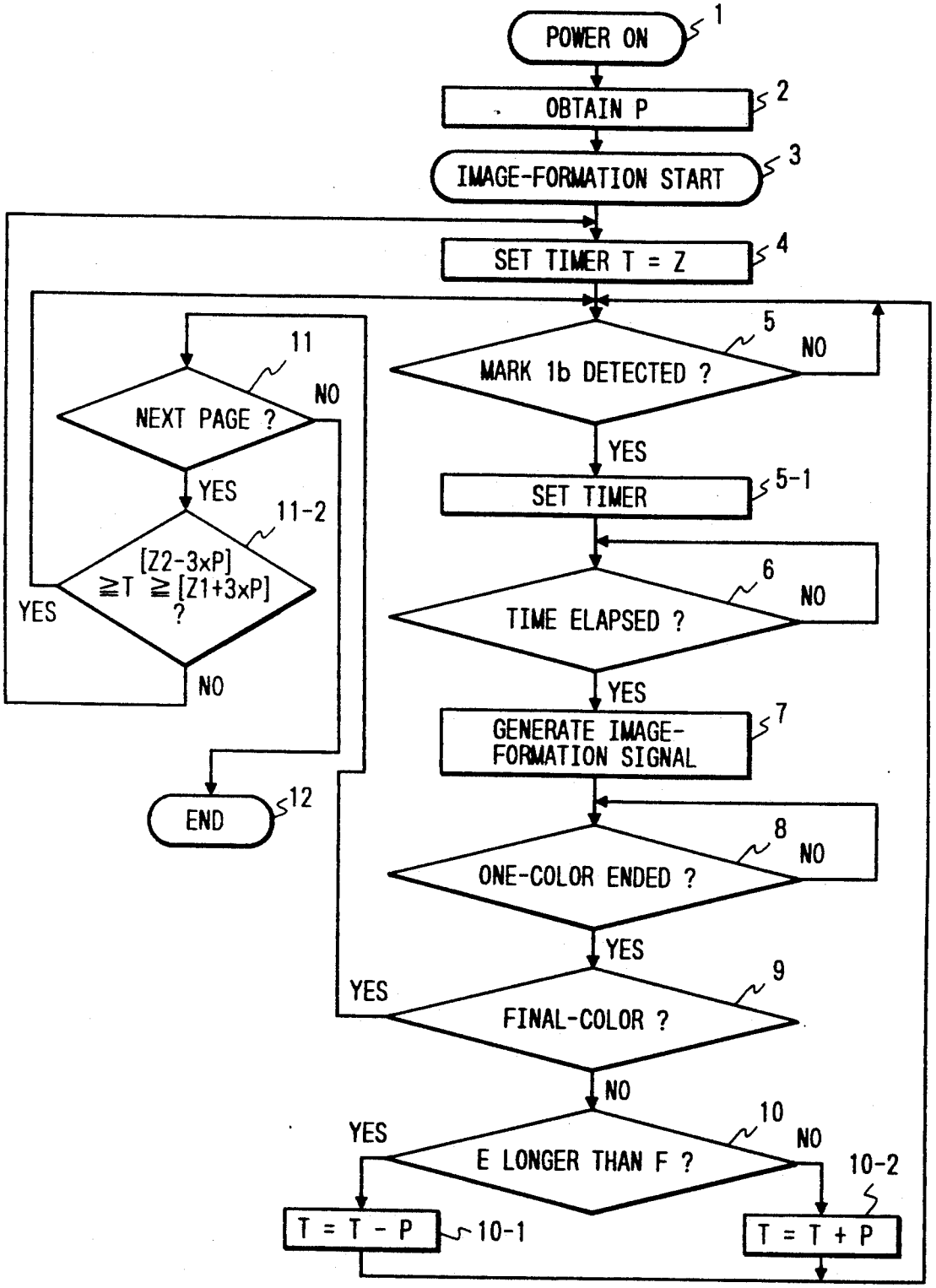
FIG. 26 is a flow chart showing an operation of an electrophotographic apparatus according to a fifth embodiment of this invention.

A fifth embodiment of this invention will be described hereinbelow with reference to FIGS. 26, 27A to 27C and 28A to 28C. Although in the above-described first embodiment the image-formation start time period is initialized to the initial image-formation start time period Z at every page (i.e., every color-combination image to be transferred through the intermediate transfer belt 16 to a copy sheet 24), in this fifth embodiment it is checked at every page as to whether the next-page color-combination image (the final-color image) area enters into the image-formation non-allowable area on the photosensitive belt 1, and if not overlapping with the non-allowable area, the image-formation start timing (time period) taken in the final-color (Y-color) image formation process for the previous page color-combination image is used as the image-formation start timing for the first-color image-formation process for the current-page color-combination image, and on the other hand if overlapping therewith, the image-formation start time period is initialized to the initial image-formation start time period Z. FIG. 26 is a flow chart showing the image-formation start control operation of an electrophotographic apparatus according to the fifth embodiment, where steps corresponding to those in the above-described embodiments are marked with the same numerals and the description thereof will be omitted for simplification.

Figure 27A:
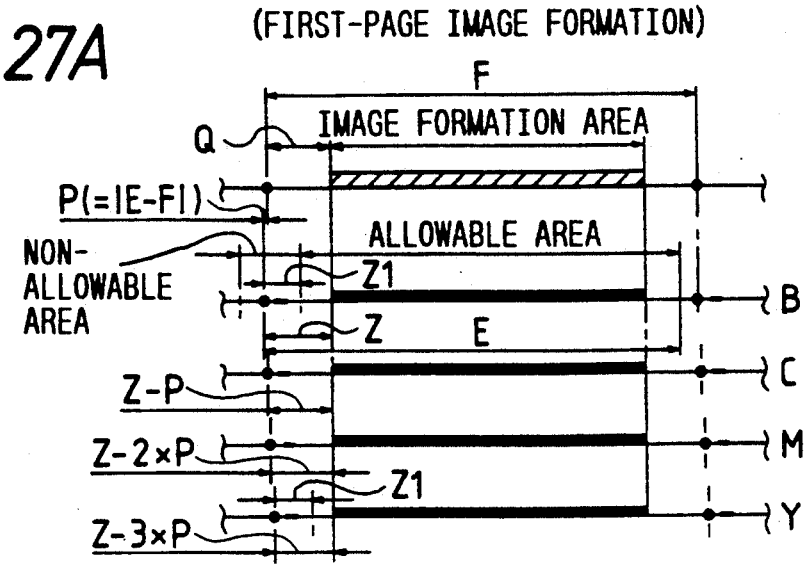
FIGS. 27A to 27C are illustrations of the image-formation start timing control of the fifth embodiment in the case that the period of the photosensitive device is longer than the period of the intermediate transfer device.
Figure 27B:
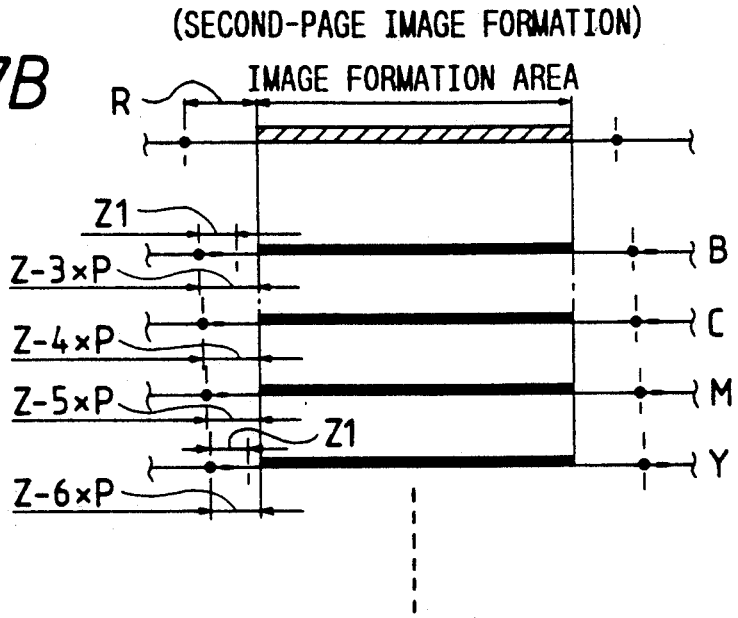
Figure 27C:
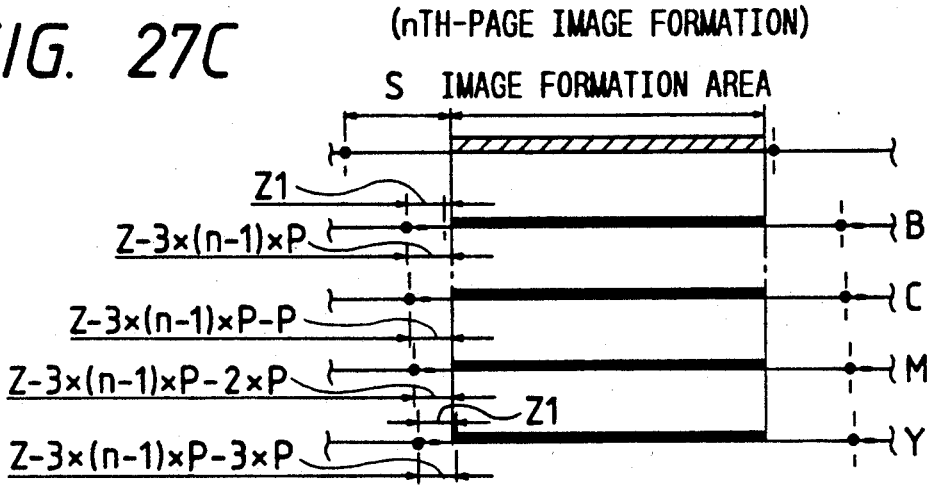
Figure 28A:
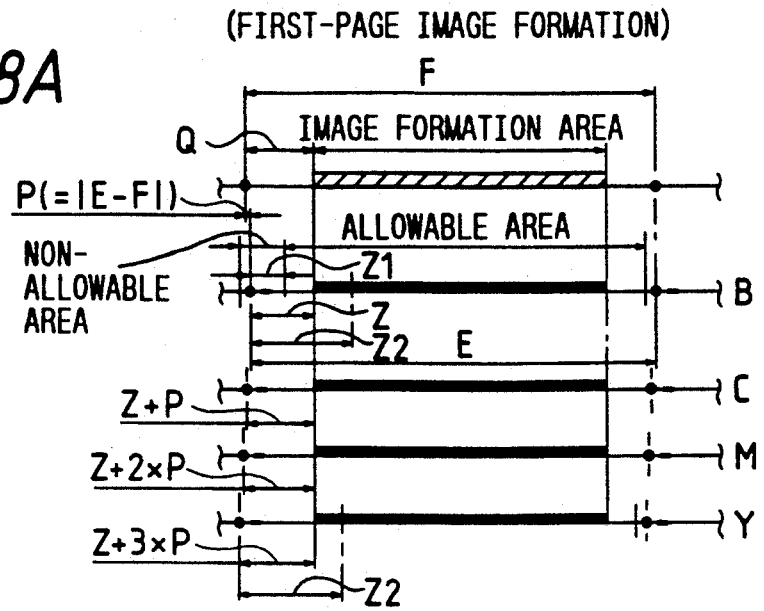
FIGS. 28A to 28C are illustrations of the image-formation start timing control of the fifth embodiment in the case that the period of the photosensitive device is shorter than the period of the intermediate transfer device.
Figure 28B:
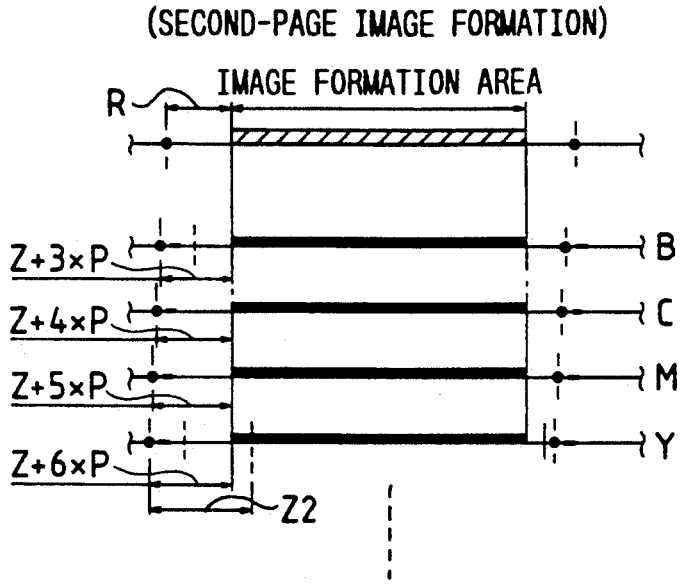
Figure 28C:
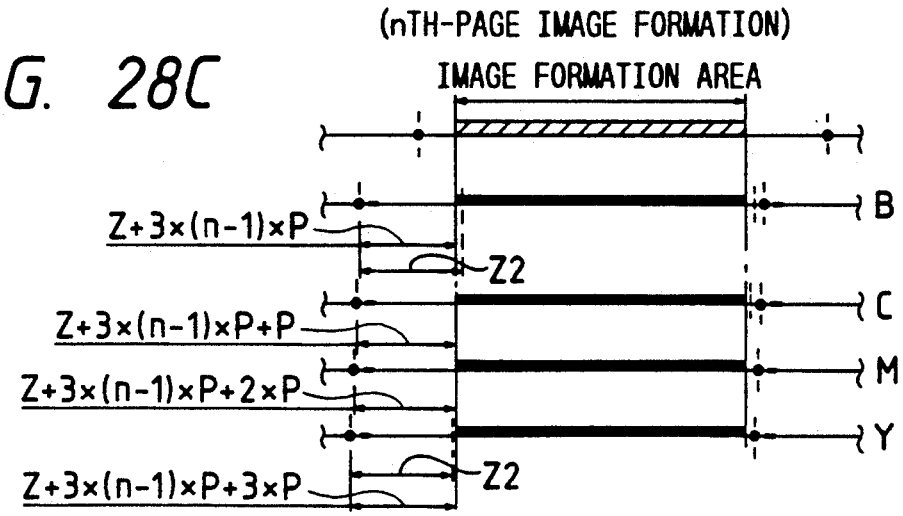

In FIG. 26, when the first-page color-combination image is completed (step 9) and there is a requirement (data) for the next-page color-combination image (step 11), the operational flow goes to a step 11-2 to check whether, when continuously performing the image formation process for the next-page color-combination image on the basis of the current image-formation start time period as it is, the final-color image-formation area is overlapped with the non-allowable area of the photosensitive belt 1, that is, check whether $Z2-3\times P \geqq T \geqq Z1+3\times P$. If $Z2-3\times P \geqq T \geqq Z1+3\times P$, in other words, if not overlapping with the non-allowable area, the operational flow goes to the step 5. That is, the image-formation start time period for the final-color image-formation process for the current-page color-combination image is used, as it is, as the image-formation start time period for the first-color image formation process for the next-page color-combination image, as illustrated in FIGS. 27A to 27C and 28A to 28C. On the other hand, If $Z2-3\times P < T$ or $T < Z1+3\times P$, in other words, if overlapping with the non-allowable area, the operational flow goes to the step 4. That is, the image-formation start time period for the first-color image formation process for the next-page color-combination image is initialized to the initial image-formation start time period Z. FIGS. 27A to 27C are illustrations of the image-formation start timing control operation of the electrophotographic apparatus according to the fifth embodiment in the case that the period (E) of the photosensitive belt 1 is longer than the period (F) of the intermediate transfer belt 16, and FIGS. 28A to 28C are illustrations of the image-formation start timing control of the apparatus according to the fifth embodiment in the case that the period (E) of the photosensitive belt 1 is shorter than the period (F) of the intermediate transfer belt 16.

Furthermore, a sixth embodiment of this invention will be described hereinbelow with reference to FIG. 29. Although in the above-described second embodiment the image-formation start time period is initialized to the initial image-formation start time period Z at every page (every color-combination image), in this sixth embodiment, as well as the aforementioned fifth embodiment, it is checked at every page as to whether of the final-color image area for the next-page color-combination image enters into the image-formation non-allowable area on the photosensitive belt 1, and if not overlapping with the non-allowable area, the image-formation start timing (time period) taken in the final-color (Y-color) image formation process for the current-page color-combination image is used as the image-formation start timing for the first-color image-formation process for the next-page color-combination image, and on the other hand if overlapping therewith, the image-formation start time period is initialized to the initial image-formation start time period Z. In addition, as well as the above-described second embodiment, the period difference P is calculated at every first-color image formation for the first-page color-combination image.

Figure 29:
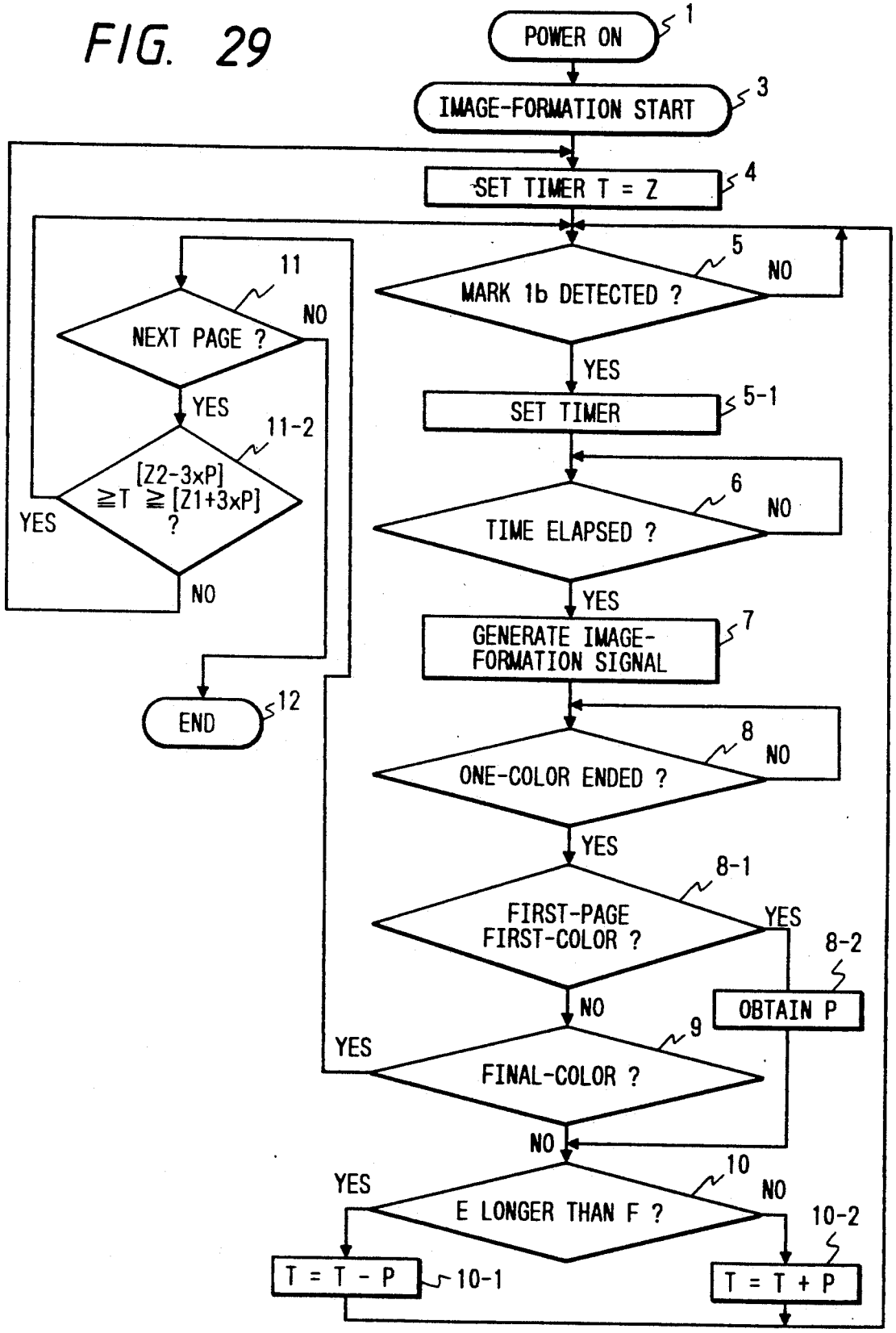
FIG. 29 is a flow chart showing an operation of an electrophotographic apparatus according to a sixth embodiment of this invention.

That is, in FIG. 29, the step 8-1 checks whether or not this process is for the first-color image formation. If so, the step 8-2 follows to calculate the period difference P between the photosensitive belt 1 and the intermediate transfer belt 16, thereafter proceeding to the steps 10 and 10-1 or 10-2 and then going to the step 5. On the other hand, if the answer of the step 8-1 is negative, the operational flow goes through the steps 9 and 11 to the step 11-2 so as to check whether $Z2-3\times P \geqq T \geqq Z1+3\times P$. If $Z2-3\times P \geqq T \geqq Z1+3\times P$, in other words, if not overlapping with the non-allowable area, the operational flow goes to the step 5. That is, the image-formation start time period for the final-color image-formation process for the current-page color-combination image is used as the image-formation start time period for the first-color image formation process for the next-page color-combination image, as illustrated in FIGS. 27A to 27C and 28A to 28C. On the other hand, If $Z2-3\times P < T$ or $T < Z1+3\times P$, in other words, if overlapping with the non-allowable area, the operational flow goes to the step 4. That is, the image-formation start time period for the first-color image formation process for the next-page color-combination image is initialized to the initial image-formation start time period Z.

In addition, a description will be made hereinbelow with reference to FIGS. 30, 31A to 31C and 32A to 32C in terms of a seventh embodiment of this invention. Although in the above-described third embodiment the image-formation start time period is initialized to the time period Z at every page (i.e., color-combination image), as well as the above-described fifth embodiment, in the seventh embodiment it is checked at every page as to whether of the final-color image area for the next-page color-combination image enters into the image-formation non-allowable area on the photosensitive belt 1, and if not overlapping with the non-allowable area, the image-formation start time period taken in the final-color (for example, Y-color) image formation process for the current-page color-combination image is used as the image-formation start timing for the first-color image-formation process for the next-page color-combination image, and on the other hand if overlapping therewith, the image-formation start time period is initialized to the initial image-formation start time period Z. The period difference (Pn) is calculated at every first-color image formation for each color-combination image.

Figure 30:
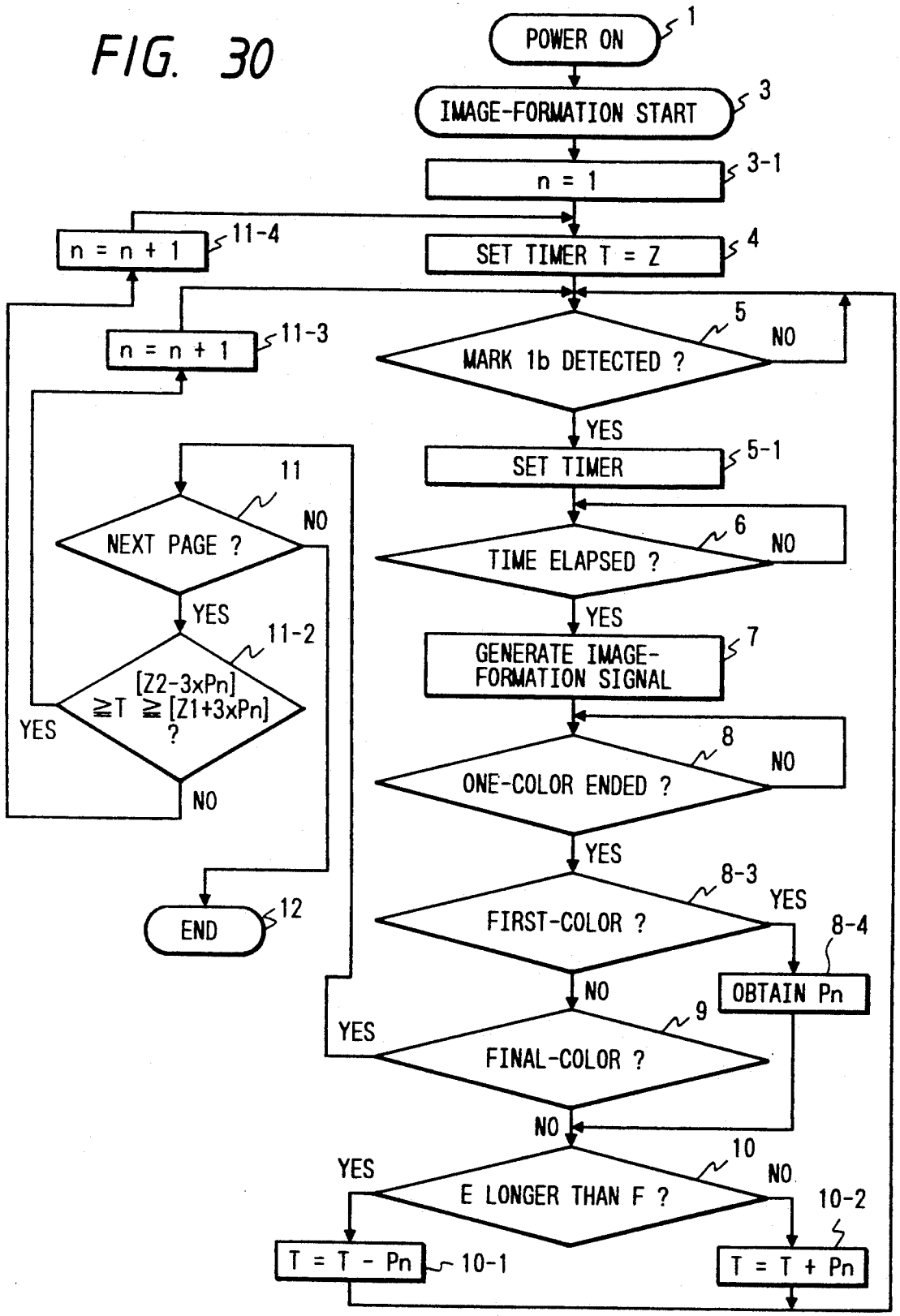
FIG. 30 a flow chart showing an operation of an electrophotographic apparatus according to a seventh embodiment of this invention.
Figure 31A:
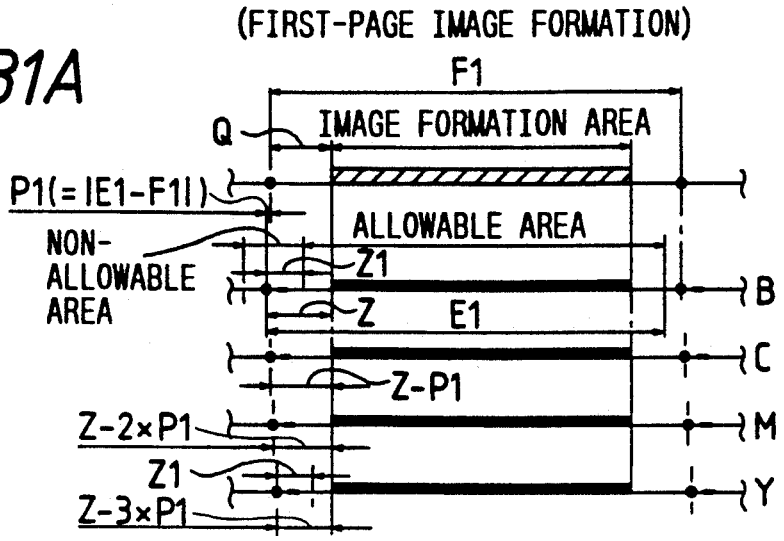
FIGS. 31A to 31C are illustrations of an image-formation start timing control of the seventh embodiment in the case that the period of the photosensitive device is longer than the period of the intermediate transfer device.
Figure 31B:
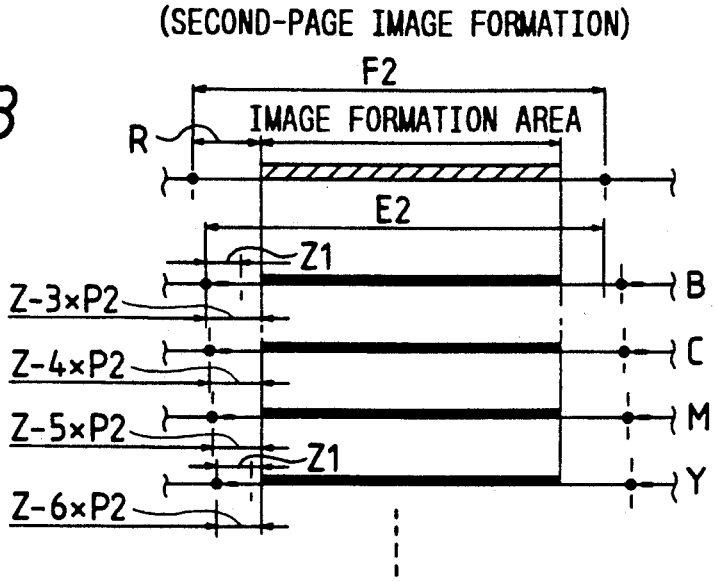
Figure 31C:
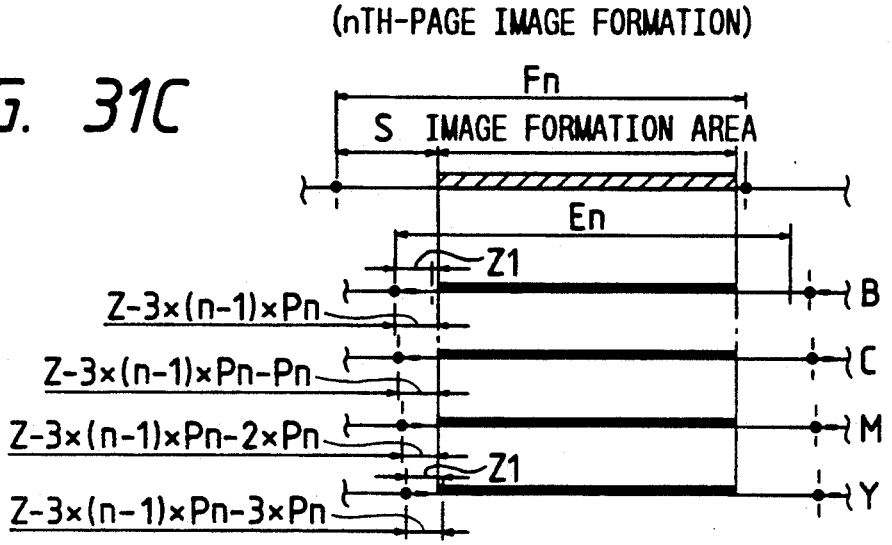
Figure 32A:
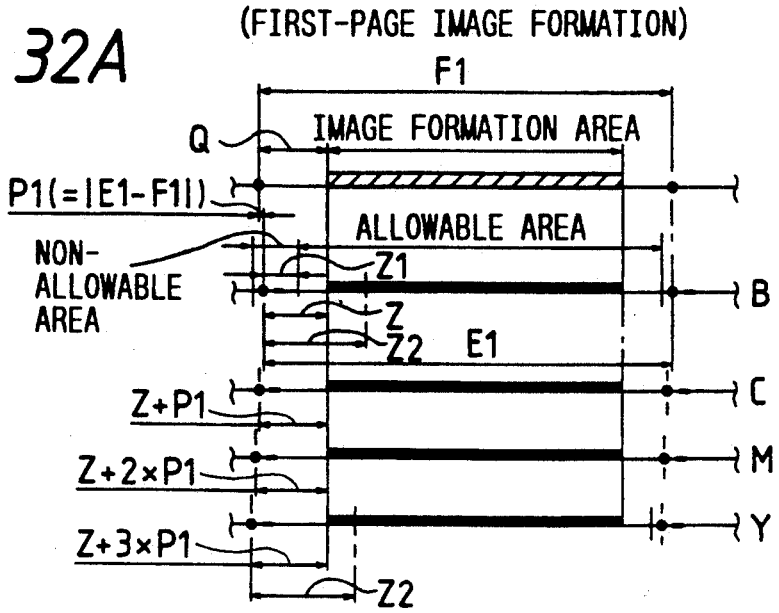
FIGS. 32A to 32C are illustrations of an image-formation start timing control of the seventh embodiment in the case that the period of the photosensitive device is shorter than the period of the intermediate transfer device.
Figure 32B:
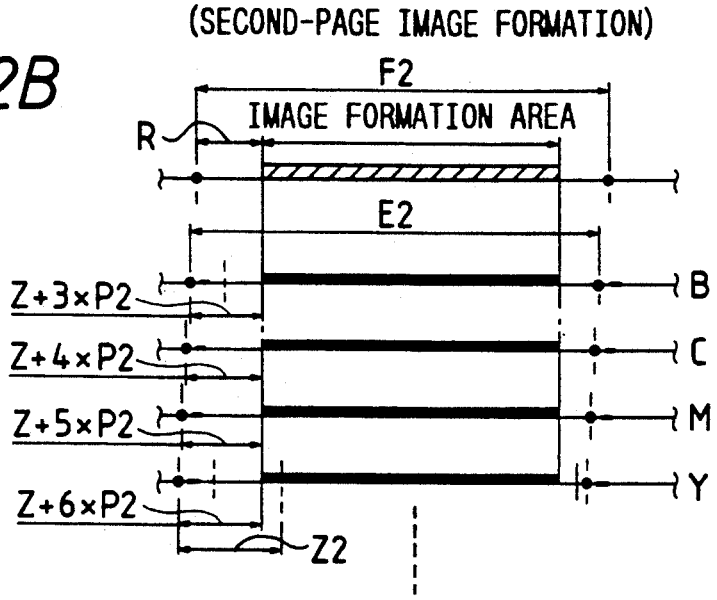
Figure 32C:
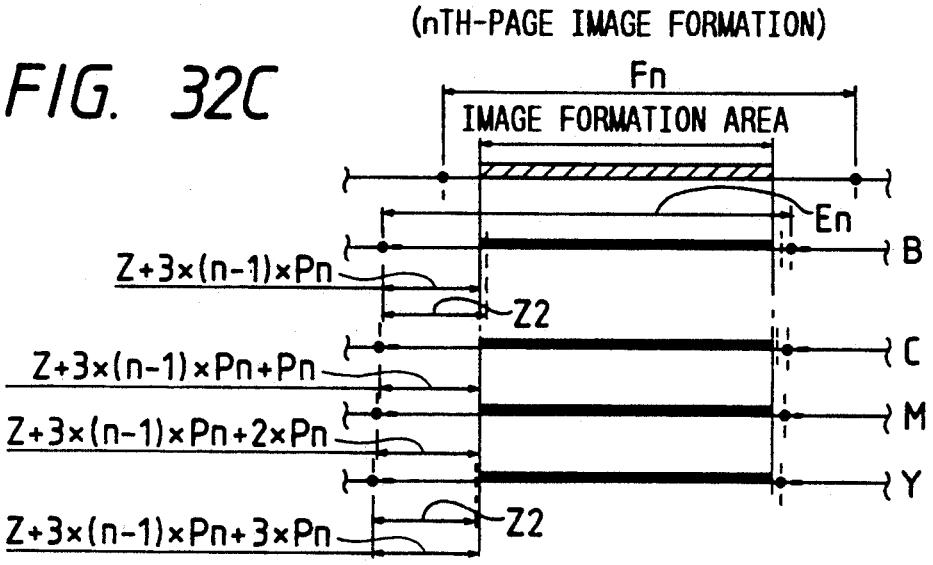

That is, in FIG. 30, when the $(n-1)$th page color-combination image formation is completed (step 9) and there is a requirement for the next-page color-combination image (step 11), the operational flow advances to the step 11-2 so as to check whether $Z2-3\times Pn \geqq T \geqq Z1+3\times Pn$. If $Z2-3\times Pn \geqq T \geqq Z1+3\times Pn$, in other words, if not overlapping with the non-allowable area, the operational flow goes to a step 11-3 in order to increment the variable n by one and then advances to the step 5. That is, the image-formation start time period for the final-color image-formation process for the $(n-1)$th-page color-combination image is used as the image-formation start time period for the first-color image formation process for the nth-page color-combination image. On the other hand, If $Z2-3\times Pn < T$ or $T < Z1+3\times Pn$, in other words, if overlapping with the non-allowable area, the operational flow goes to a step 11-4 to increment the variable n by one. That is, the image-formation start time period for the first-color image formation process for the next-page color-combination image is initialized to the initial image-formation start time period Z. FIGS. 31A to 31C are illustrations of the image-formation start timing control of the seventh embodiment in the case that the period (E) of the photosensitive belt 1 is longer than the period (F) of the intermediate transfer belt 16, and FIGS. 32A to 32C are illustrations of the image-formation start timing control of the seventh embodiment in the case that the period (E) of the photosensitive belt 1 is shorter than the period (F) of the intermediate transfer belt 16.

Moreover, a description will be made hereinbelow with reference to FIGS. 33, 34A to 34C and 35A to 35C in terms of an operation of an electrophotographic apparatus according to an eighth embodiment of this invention. Although in the above-described fourth embodiment the image-formation start time period is initialized to the initial image-formation start time period Z at every color-combination image formation, in the eighth embodiment it is checked at every page as to whether of the final-color image area for the next-page color-combination image enters into the image-formation non-allowable area on the photosensitive belt 1, and if not overlapping with the non-allowable area, the image-formation start time period taken in the final-color (for example, Y-color) image formation process for the current-page color-combination image is used as the image-formation start timing for the first-color image-formation process for the next-page color-combination image, and on the other hand if overlapping therewith, the image-formation start time period is initialized to the initial image-formation start time period Z.

Figure 33:
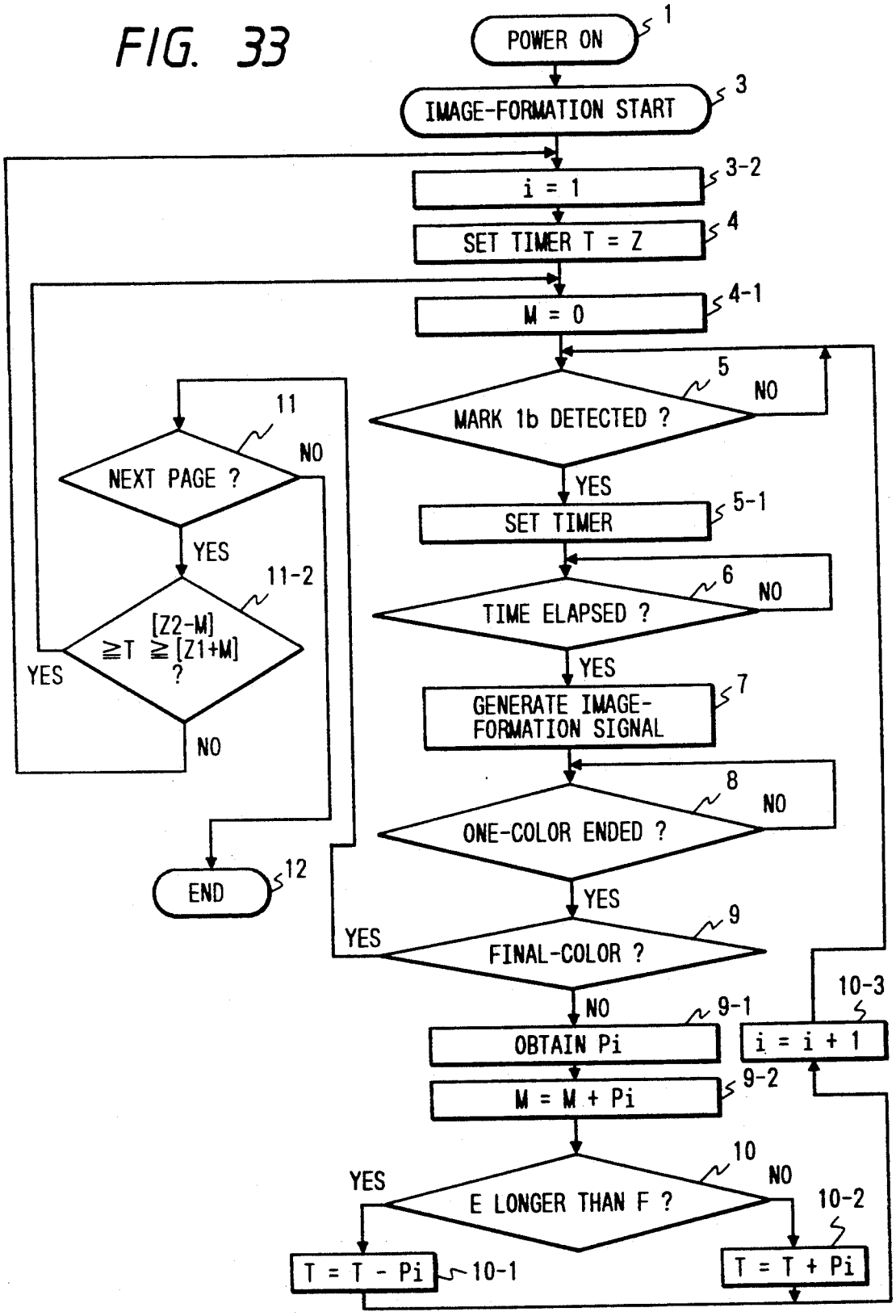
FIG. 33 is a flow chart showing an operation of an electrophotographic apparatus according to an eighth embodiment of this invention.
Figure 34A:
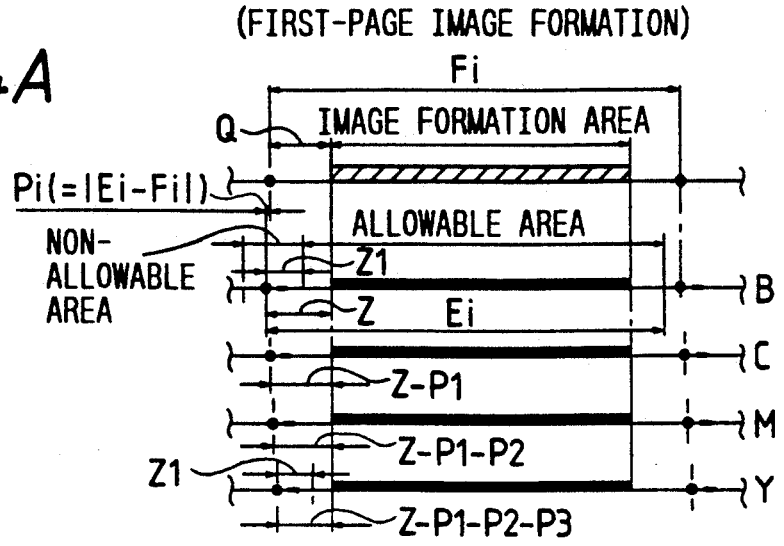
FIGS. 34A to 34C are illustrations of an image-formation start timing control operation of the eighth embodiment of this invention in the case that the period of the photosensitive device is longer than the period of the intermediate transfer device.
Figure 34B:
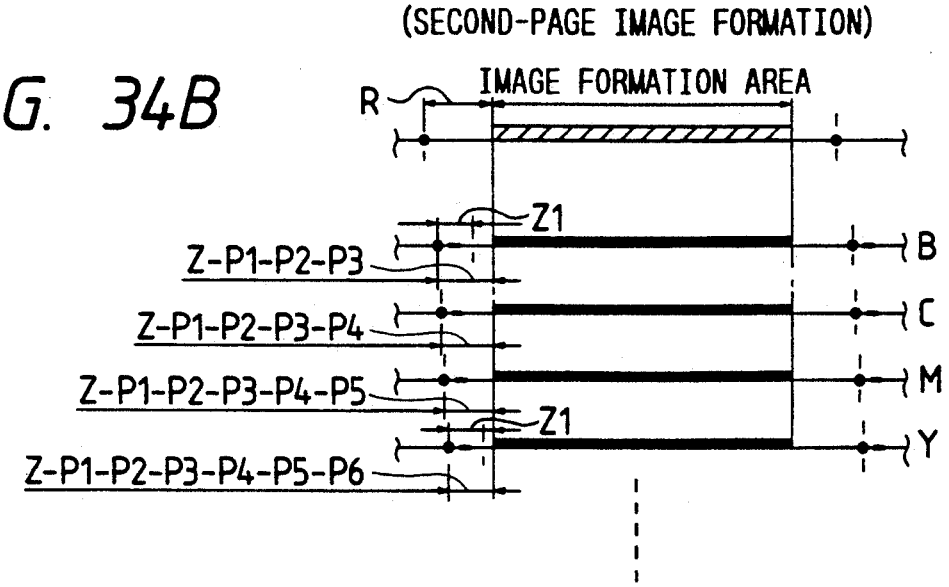
Figure 34C:
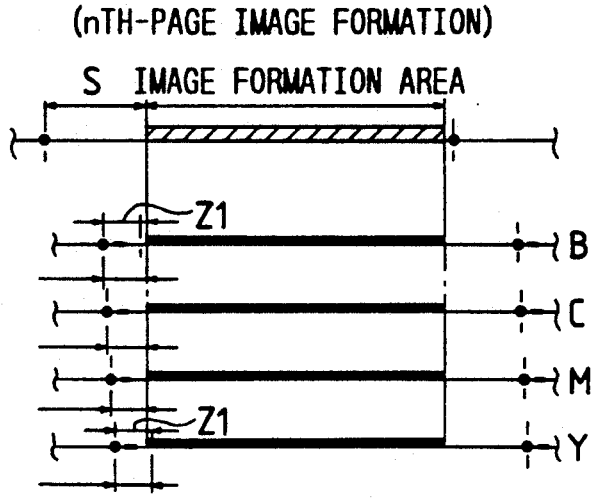
Figure 35A:
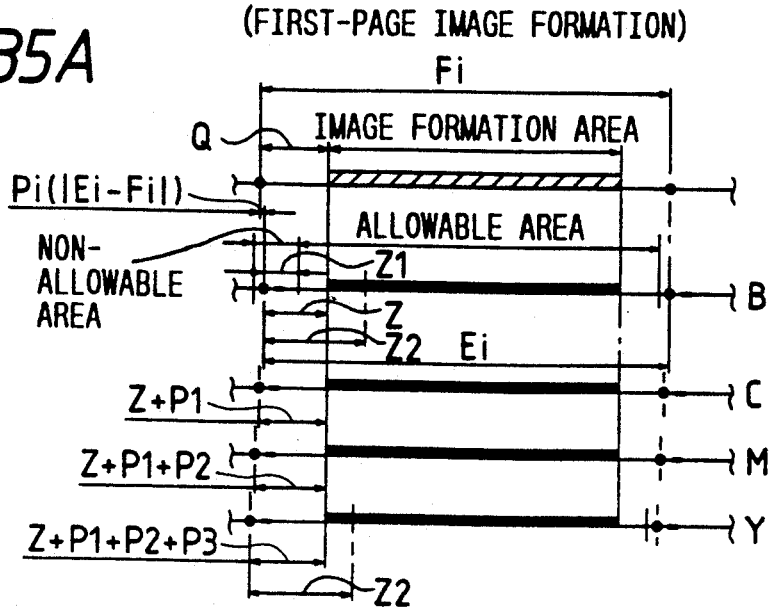
FIGS. 35A to 35C are illustrations of the image-formation start timing control operation of the eighth embodiment of this invention in the case that the period of the photosensitive device is shorter than the period of the intermediate transfer device.
Figure 35B:
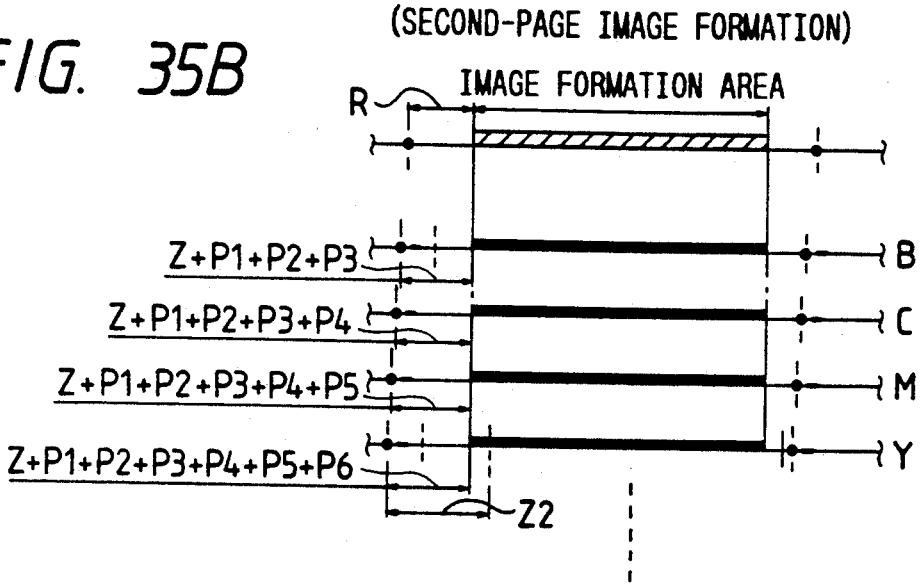
Figure 35C:
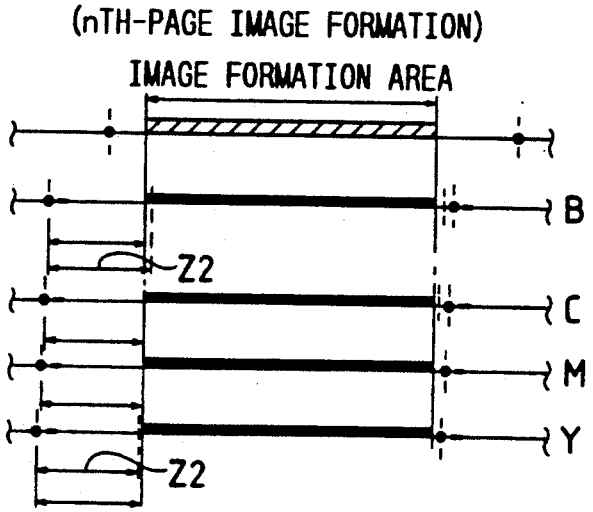

That is, in FIG. 33, after the execution of the step 4, a step 4-1 follows in order to set or initialize a variable M to 0, and after the executions of the steps 5 to 8, the step 9 is executed so as to check whether this image formation process is for the final-color image formation. If the decision of the step 9 is negative, the operational flow goes to a step 9-1 in order to obtain the period difference Pi between the photosensitive belt 1 and the intermediate transfer belt 16 at every color (each of the first to final-color image-formation processes). The obtained period difference Pi is successively added to the variable M in a subsequent step 9-2. On the other hand, if the decision of the step 9 is affirmative, the operational flow advances through the step 11 to a step 11-2 to check whether the final-color image formation area for the next-page color-combination image is overlapped with the non-allowable area of the photosensitive belt 1, that is, check whether $Z2-M \geqq T \geqq Z1+M$. If the answer of the step 11-2 is "YES", the operational flow advances to the steps 4-1 and 5. The variable M is initialized to 0 and the image-formation start time period for the final-color image formation of the current-page color-combination image is used as the image-formation start period for the first-color image formation for the next-page color-combination image. On the other hand, if the answer of the step 11-2 is "NO", that is, if $Z2-M < T$ and $T < Z1+M$, the operational flow goes to the steps 3-2 and 4. That is, the variable i is initialized to 1 in the step 3-2 and the image-formation start time period is initialized to the initial image-formation start time period Z in the step 4. FIGS. 34A to 34C are illustrations of the image-formation start timing control operation of the eighth embodiment of this invention in the case that the period (E) of the photosensitive belt 1 is longer than the period (F) of the intermediate transfer belt 16, and FIGS. 35A to 35C are illustrations of the image-formation start timing control operation of the eighth embodiment of this invention in the case that the period (E) of the photosensitive belt 1 is shorter than the period (F) of the intermediate transfer belt 16.

Figure 36:
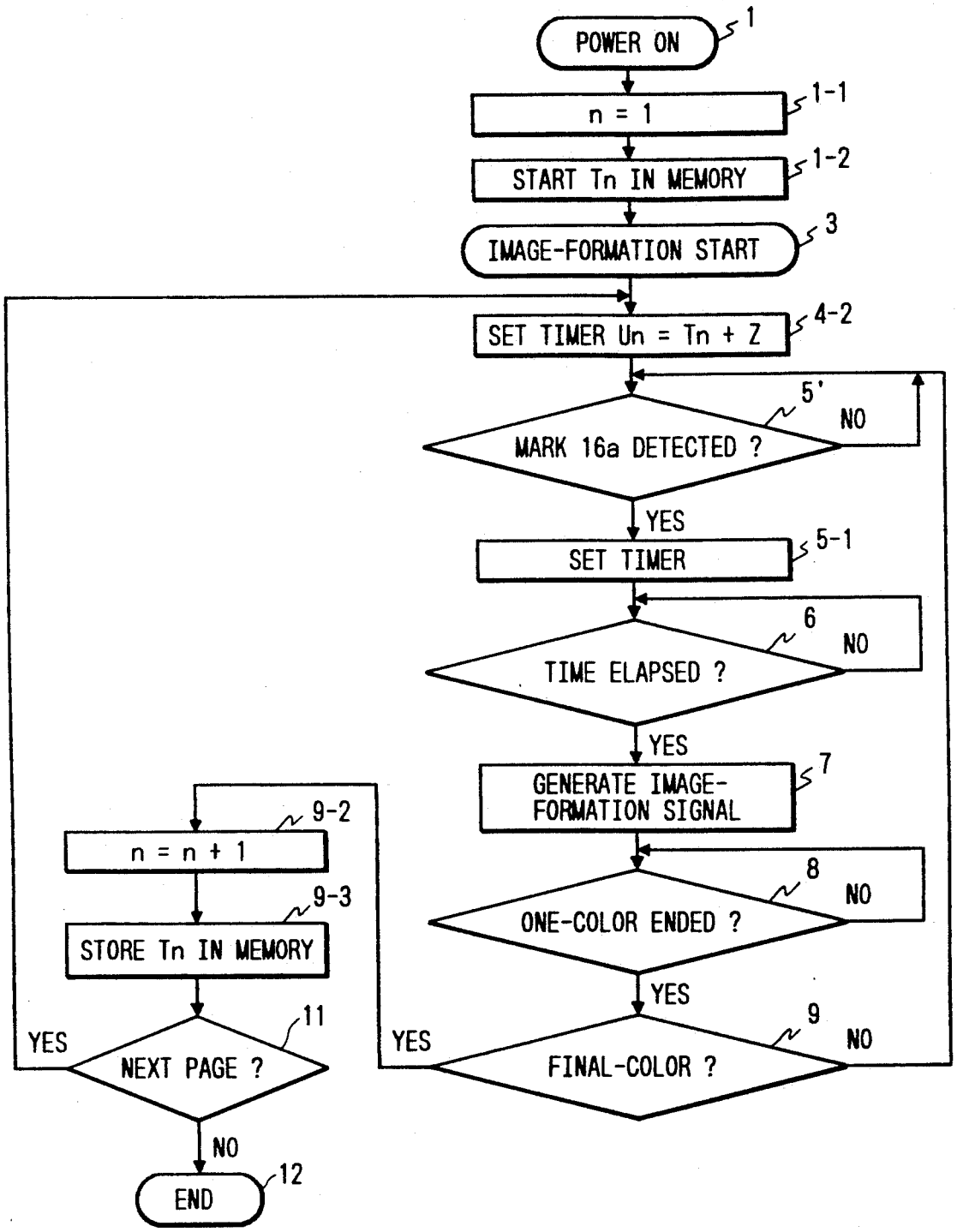
FIG. 36 is a flow chart showing an operation of a ninth embodiment of a ninth embodiment of this invention.

Furthermore, a ninth embodiment of this invention will be described with reference to FIG. 36. This ninth embodiment is arranged to perform the image-formation start timing adjustment on the basis of the reference mark detection signal from the reference position sensor 20 provided with respect to the intermediate transfer device 16. Here, the description of the ninth embodiment will be made in terms of the case that the period (E) of the photosensitive belt 1 is shorter than the period (F) of the intermediate transfer belt 16. FIG. 36 is a flow chart showing the image-formation start timing control of an electrophotographic apparatus of the ninth embodiment, where steps corresponding to those in the above-described embodiments are marked with the same numerals. In FIG. 36, in response to the turning-ON of the power source of the apparatus in the step 1, a step 1-1 is executed to set to a variable n to 1. Both the photosensitive belt 1 and intermediate transfer belt 16 first start to rotate for the initialization and the CPU 102 measures the time period (time difference) T1 from the time that the transfer-belt reference position sensor 20 detects the reference mark 16*a* to the time that the photosensitive-belt reference position sensor 10 detects the reference mark 1*b*. The measurement of the time period T1 is made when both the photosensitive belt 1 and intermediate transfer belt 16 normally rotate, that is, immediately before the termination of the rotations of both the photosensitive belt 1 and intermediate transfer belt 16, and the measurement value T1 is stored in a memory (not shown) in a step 1-2. This time period measurement is made at every period so that the time period Tn is updated at every period by the CPU 102 (FIG. 12) while the photosensitive belt 1 and the intermediate transfer belt 16 rotate along predetermined paths.

Figure 37A:
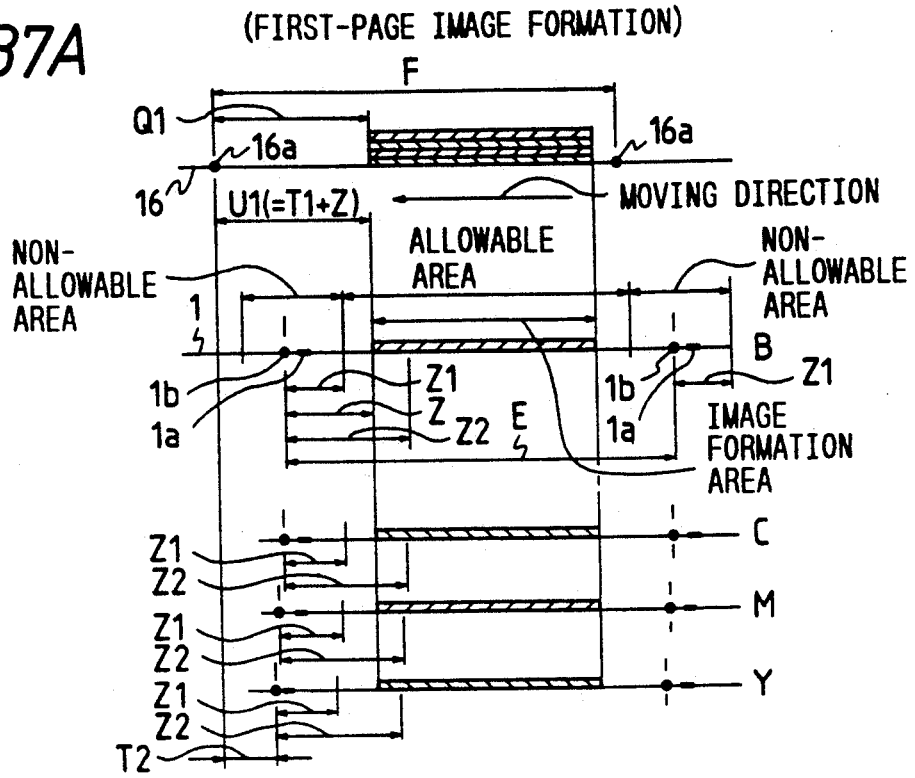
FIGS. 37A and 37B are illustrations of an image-formation start timing control operation of the ninth embodiment of this invention in the case that the period of the photosensitive device is shorter than the period of the intermediate transfer device.

For the first-page color-combination image formation, the step 3 is executed in order to generate an image-formation start signal, then followed by a step 4-2 to set an initial image-formation start time period U1 (=Z+T1) through the image-formation start position designation register 103 to the timer 101 whereby the first-color (for example, B-color) image-formation signal is generated so as to emit the corresponding exposure light beam 14 toward the photosensitive belt 1 after the elapses of the time period Z from the detection of the reference mark 1b by the photosensitive-belt reference position sensor 10 and the time period T1 stored in the memory in the aforementioned step 1-2 as illustrated in FIG. 37A. This initial image-formation start time period U1 is determined so that the image-formation start position and the image-formation terminating position does not enter into the non-allowable area of the photosensitive belt 1. Here, the period difference P between the period (E) of the photosensitive belt 1 and the period (F) of the intermediate transfer belt 16 is an extremely short time as compared with the initial image-formation start time period U1, and the length of the photosensitive belt 1 and the length of the intermediate transfer belt 16 are determined so that the area from the first-page first-color image formation to the first-page final-color image formation does not enter into the non-allowable area.

When in a subsequent step 5' the transfer-belt reference position sensor 20 detects the reference mark 16*a*, the timer 101 starts in the step 5-1 and, when the time period U1 is counted in the step 6, the image-formation signal is generated in the step 7, thereby forming the B-color electrostatic latent image on the photosensitive belt 1 to then form the corresponding B-color toner image thereon. The formed B-color toner image is transferred onto the intermediate transfer belt 16 after the elapse of a time period Q1 from the detection of the reference mark 16*a* by the reference position sensor 20 as illustrated in FIG. 37A.

In the step 9 it is checked whether the image-formation signal is for the final-color image. If the answer of the step 9 is negative, the operational flow returns to the step 5' for the next-color image formation (for example, C-color image formation). Here, the C-color toner image to be formed on the photosensitive belt 1 is required to be transferred onto the intermediate transfer belt 16 when the time period Q1 is elapsed after the transfer-belt reference position sensor 20 detects the reference mark 16*a*. If not, the C-color image-formation timing is not coincident with the B-color image-formation timing so that the image slippage occurs between the B-color image and the C-color image. For the coincidence therebetween, the image formation is required to be started after the elapse of the time period U1 from the detection of the reference mark 16*a* by the reference position sensor 20 as well as in the case of the B-color image formation. Accordingly, in response to the generation of the next transfer-belt reference position signal by reference position sensor 20 in the step 5, the timer 101 starts in the step 5-1, the image-formation signal is generated in the step 7 after the time period U1 is elapsed in the step 6, whereby the corresponding exposure light beam 14 is emitted to the photosensitive belt 1 so as to form an electrostatic latent image on the photosensitive belt 1 and then to form a C-color toner image thereon by means of the developing device 6C. The formed C-color toner image can be transferred accurately onto the intermediate transfer belt 16 after the elapse of the time period Q1 from the detection of the reference mark 16*a*. The similar processes are performed for the M-color and Y-color image formations, thereby obtaining the first-page color-combination image to be transferred from the intermediate transfer belt 16 onto the copy sheet 24.

On the other hand, if the decision of the step 9 is "YES", that is, if the current image-formation signal is for the Y-color image formation, the operational flow proceeds to a step 9-2 so as to increment the variable n by one (n=2), then followed by a step 9-3 in order to store in the memory the time difference T2 between the photosensitive-belt reference position detection and the transfer-belt reference position detection which time difference has been measured during the final-color (Y-color) image formation process. Thereafter, the operational flow advances to the step 11 to check whether there is a requirement (data) for the next-page color-combination image formation. If not, this operation terminates in the step 12. If so, the operational flow returns to the above-mentioned step 4-2 for the next-page color-combination image formation.

Figure 37B:
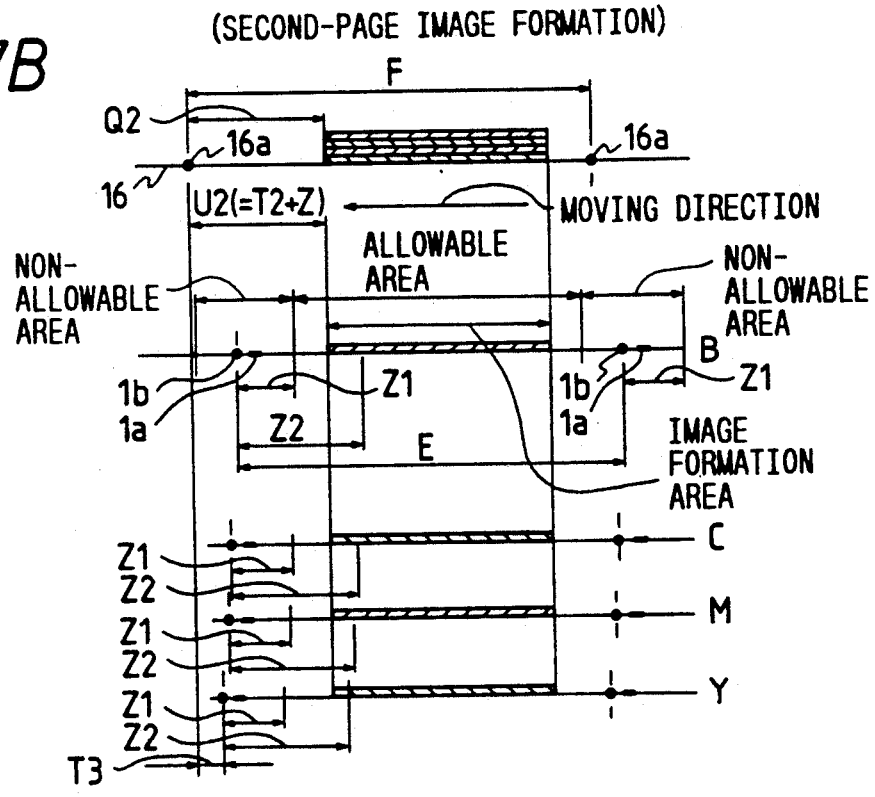

For the second-page color-combination image formation, in the step 4-2 a time period U2 (Z+T2) is calculated on the basis of the time period Z from the detection of the reference mark 1*b* by the photosensitive-belt reference position sensor 10 and the time period T2 stored in the memory in the step 9-3 and then set through the start position designation register 103 to the timer 101, thereby, as illustrated in FIG. 37B, generating the image-formation signal in response to the elapse of the time period U2 in the step 8 after the executions of the steps 5' to 6 so as to form a B-color electrostatic latent image on the photosensitive belt 1 and then form a B-color toner image through the B-color developing device 6B. The B-color toner image formed on the photosensitive belt 1 is transferred onto the intermediate transfer belt 16 when a time period Q2 is elapsed after the transfer-belt reference position sensor 20 detects the reference mark 16*a*.

After the completion of the one-color image formation (step 8), the operational flow goes to the step 9 in order to check whether or not it is the final-color image formation. If not, the step 5' again follows to repeatedly perform the similar process for the next-color (C-color) image formation, that is, performing the C-color image-formation after the elapse of the time period U2 from the detection of the reference mark 16*a* and performing the transfer of the toner image onto the intermediate transfer belt 16 after the elapse of the time period Q2 from the detection of the reference mark 16*a*. Thus, it is possible to obtain an adequate color-combination image without the occurrence of the image slippage.

On the other hand, if the decision of the step 9 is affirmative, the operational flow proceeds to the step 9-2 to count up the variable n by one (n=3) and then to the step 9-3 to store in the memory the time difference T3 between the photosensitive-belt reference position detection and the transfer-belt reference position detection, measured during the final-color image-formation process. Thereafter, if there is a further color-combination image-formation requirement (step 11), the operational flow again returns to the step 4-2 to perform the similar operation for the third-page color-combination image.

Figure 38A:
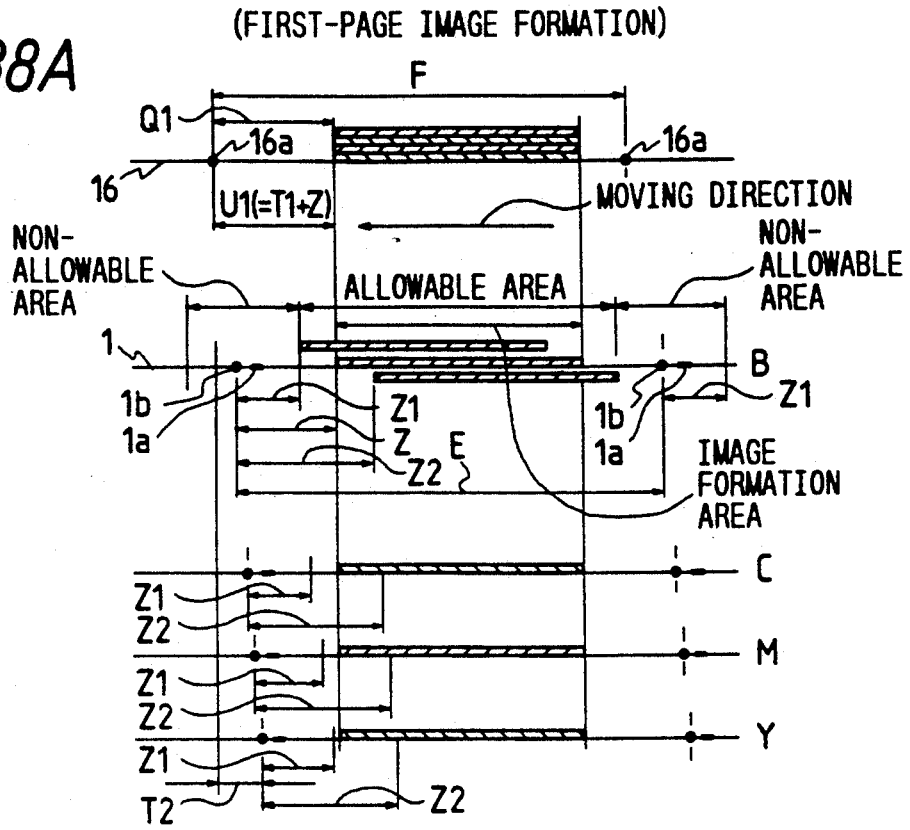
FIGS. 38A 38B are illustrations of the image-formation start timing control operation of the ninth embodiment of this invention in the case that the period of the photosensitive device is longer than the period of the intermediate transfer device.
Figure 38B:
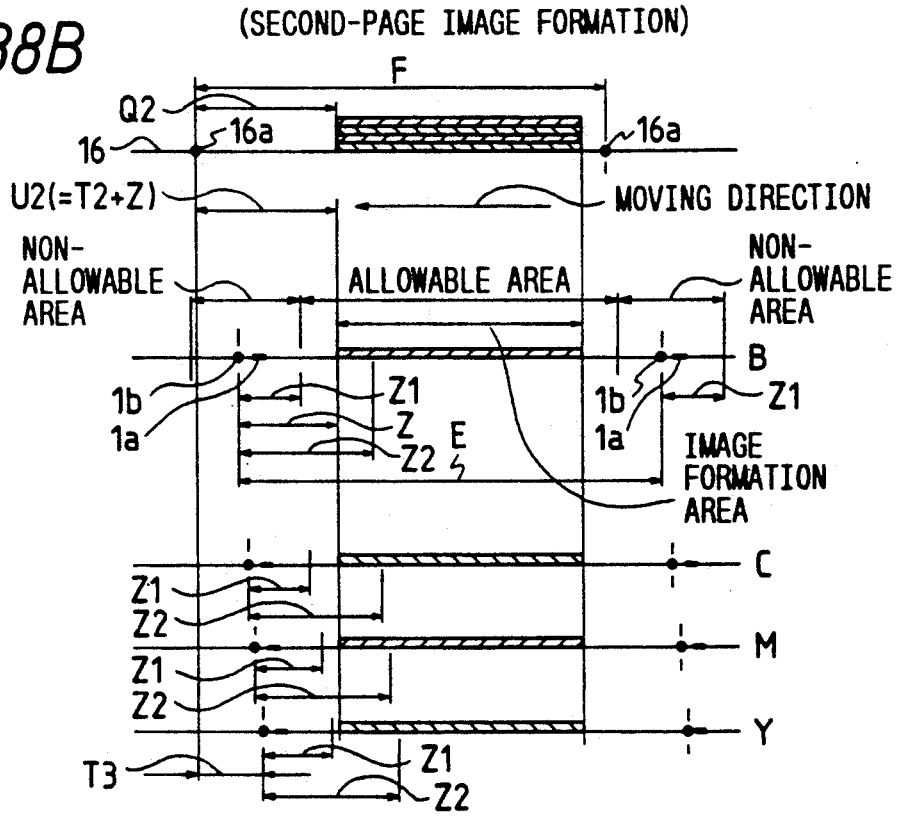

In the case that the period (E) of the photosensitive belt 1 is longer than the period (F) of the intermediate transfer belt 16, the image-formation start timing control is executed as shown in FIGS. 38A and 38B.

According to the above-described embodiments of the present invention, the image-formation operation can continuously be performed without the requirement of adjusting the position of the photosensitive belt with respect to the intermediate transfer belt by means of the clutch mechanism.

In the above description, the ranges of the steps 11-2 in FIGS. 26, 29, 30 and 33 are determined as intervals that all the color image formation areas do not enter into the image-formation non-allowable area. That is, in the case that the period of the photosensitive device is longer than the period of the intermediate transfer device, since the period difference P is subtracted from the initial value T at every color image formation, the formation start position of the final-color image becomes $Z-3\cdot P$. Thus, the range of T becomes $Z1+3\cdot P<=T<Z2$. On the other hand, in the case that the period of the photosensitive device is shorter than the period of the intermediate transfer device, the period difference P is added to the initial value T at every image formation and hence the final-color image formation start position becomes $Z1<=T<=Z2-3\cdot P$.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. An electrophotographic apparatus comprising:

photosensitive means arranged to be rotatable with a first period in a first predetermined direction and having a photosensitive layer on its one surface which is responsive to an exposure light beam so as to allow continuous formation of a plurality of images for each of a plurality of color pictures, said photosensitive means being equipped with a first reference mark indicate of a predetermined position of said photosensitive means in said first predetermined rotational direction;

first reference position sensor means for detecting said first reference mark of said photosensitive means and outputting a detection signal indicative of the detection of said first reference mark;

intermediate transfer means arranged to be rotatable with a second period in a second predetermined direction and arranged to be brought into contact with said photosensitive layer of said photosensitive means so that said plurality of images for each of said color pictures formed on said photosensitive layer are transferred onto a surface of said intermediate transfer means, the transferred images being integrally transferred onto a copy sheet to form each of said plurality of color pictures thereon, and said intermediate transfer means being equipped with a second reference mark indicative of a predetermined position of said intermediate transfer means in said second predetermined rotational direction;

second reference position sensor means for detecting said second reference mark of said intermediate transfer means and outputting a detection signal indicative of the detection of said second reference mark;

period difference calculating means responsive to said detection signals from said first and second reference position sensor means so as to calculate a difference between said first rotational period of said photosensitive means and said second rotational period of said intermediate transfer means and control means coupled to said period difference calculating means for controlling a start timing of the formation of each of said plurality of images on said photosensitive layer of said photosensitive means on the basis of the period difference calculated by said period difference calculating means, wherein said difference period calculating means calculates the period difference between said first and second rotational periods of both said photosensitive means and intermediate transfer means in response to turning-ON of a power source of said apparatus.

2. An electrophotographic apparatus comprising:

photosensitive means arranged to be rotatable with a first period in a first predetermined direction and having a photosensitive layer on its one surface which is responsive to an exposure light beam so as to allow continuous formation of a plurality of images for each of a plurality of color pictures, said photosensitive means being equipped with a first reference mark indicate of a predetermined position of said photosensitive means in said first predetermined rotational direction;

first reference position sensor means for detecting said first reference mark of said photosensitive means and outputting a detection signal indicative of the detection of said first reference mark;

intermediate transfer means arranged to be rotatable with a second period in a second predetermined direction and arranged to be brought into contact with said photosensitive layer of said photosensitive means so that said plurality of images for each of said color pictures formed on said photosensitive layer are transferred onto a surface of said intermediate transfer means, the transferred images being integrally transferred onto a copy sheet to form each of said plurality of color pictures thereon, and said intermediate transfer means being equipped with a second reference mark indicative of a predetermined position of said intermediate transfer means in said second predetermined rotational direction;

second reference position sensor means for detecting said second reference mark of said intermediate transfer means and outputting a detection signal indicative of the detection of said second reference mark;

period difference calculating means responsive to said detection signals from said first and second reference position sensor means so as to calculate a difference between said first rotational period of said photosensitive means and said second rotational period of said intermediate transfer means and control means coupled to said period difference calculating means for controlling a start timing of the formation of each of said plurality of images on said photosensitive layer of said photosensitive means on the basis of the period difference calculated by said period difference calculating means, wherein said difference period calculating means calculates the period difference between said first and second rotational periods of both said photosensitive means and intermediate transfer means during the formation of a first image of said plurality of images for a first color picture.

3. An electrophotographic apparatus comprising:

photosensitive means arranged to be rotatable with a first period in a first predetermined direction and having a photosensitive layer on its one surface which is responsive to an exposure light beam so as to allow continuous formation of a plurality of images for each of a plurality of color pictures, said photosensitive means being equipped with a first reference mark indicate of a predetermined position of said photosensitive means in said first predetermined rotational direction;

first reference position sensor means for detecting said first reference mark of said photosensitive means and outputting a detection signal indicative of the detection of said first reference mark;

intermediate transfer means arranged to be rotatable with a second period in a second predetermined direction and arranged to be brought into contact with said photosensitive layer of said photosensitive means so that said plurality of images for each of said color pictures formed on said photosensitive layer are transferred onto a surface of said intermediate transfer means, the transferred images being integrally transferred onto a copy sheet to form each of said plurality of color pictures thereon, and said intermediate transfer means being equipped with a second reference mark indicative of a predetermined position of said intermediate transfer means in said second predetermined rotational direction;

second reference position sensor means for detecting said second reference mark of said intermediate transfer means and outputting a detection signal indicative of the detection of said second reference mark;

period difference calculating means responsive to said detection signals from said first and second reference position sensor means so as to calculate a difference between said first rotational period of said photosensitive means and said second rotational period of said intermediate transfer means and control means coupled to said period difference calculating means for controlling a start timing of the formation of each of said plurality of images on said photosensitive layer of said photosensitive means on the basis of the period difference calculated by said period difference calculating means, wherein said difference period calculating means calculates the period difference between said first and second rotational periods of both said photosensitive means and intermediate transfer means during the formation of a first image of said plurality of images for each of said plurality of color pictures.

4. An electrophotographic apparatus comprising:

photosensitive means arranged to be rotatable with a first period in a first predetermined direction and having a photosensitive layer on its one surface which is responsive to an exposure light beam so as to allow continuous formation of a plurality of images for each of a plurality of color pictures, said photosensitive means being equipped with a first reference mark indicate of a predetermined position of said photosensitive means in said first predetermined rotational direction;

first reference position sensor means for detecting said first reference mark of said photosensitive means and outputting a detection signal indicative of the detection of said first reference mark;

intermediate transfer means arranged to be rotatable with a second period in a second predetermined direction and arranged to be brought into contact with said photosensitive layer of said photosensitive means so that said plurality of images for each of said color pictures formed on said photosensitive layer are transferred onto a surface of said intermediate transfer means, the transferred images being integrally transferred onto a copy sheet to form each of said plurality of color pictures thereon, and said intermediate transfer means being equipped with a second reference mark indicative of a predetermined position of said intermediate transfer means in said second predetermined rotational direction;

second reference position sensor means for detecting said second reference mark of said intermediate transfer means and outputting a detection signal indicative of the detection of said second reference mark;

period difference calculating means responsive to said detection signals from said first and second reference position sensor means so as to calculate a difference between said first rotational period of said photosensitive means and said second rotational period of said intermediate transfer means and control means coupled to said period difference calculating means for controlling a start timing of the formation of each of said plurality of images on said photosensitive layer of said photosensitive means on the basis of the period difference calculated by said period difference calculating means, wherein said difference period calculating means calculates the period difference between said first and second rotational periods of both said photosensitive means and intermediate transfer means at every formation of each said plurality of images for each of said plurality of color pictures, and said control means controls said image-formation start timing of the current image formation on the basis of the period difference calculated during the previous image formation.

5. An electrophotographic apparatus comprising:

photosensitive means arranged to be rotatable with a first period in a first predetermined direction and having a photosensitive layer on its one surface which is responsive to an exposure light beam so as to allow continuous formation of a plurality of images for each of a plurality of color pictures, said photosensitive means being equipped with a first reference mark indicate of a predetermined position of said photosensitive means in said first predetermined rotational direction;

first reference position sensor means for detecting said first reference mark of said photosensitive means and outputting a detection signal indicative of the detection of said first reference mark;

intermediate transfer means arranged to be rotatable with a second period in a second predetermined direction and arranged to be brought into contact with said photosensitive layer of said photosensitive means so that said plurality of images for each of said color pictures formed on said photosensitive layer are transferred onto a surface of said intermediate transfer means, the transferred images being integrally transferred onto a copy sheet to form each of said plurality of color pictures thereon, and said intermediate transfer means being equipped with a second reference mark indicative of a predetermined position of said intermediate transfer means in said second predetermined rotational direction;

second reference position sensor means for detecting said second reference mark of said intermediate transfer means and outputting a detection signal indicative of the detection of said second reference mark;

period difference calculating means responsive to said detection signals from said first and second reference position sensor means so as to calculate a difference between said first rotational period of said photosensitive means and said second rotational period of said intermediate transfer means and control means coupled to said period difference calculating means for controlling a start timing of the formation of each of said plurality of images on said photosensitive layer of said photosensitive means on the basis of the period difference calculated by said period difference calculating means, wherein control means determines said image-formation start timing as a time period from a time that said first reference position sensor outputs said detection signal indicative of the detection of said first reference mark of said photosensitive means.

6. An electrophotographic apparatus comprising:

photosensitive means arranged to be rotatable with a first period in a first predetermined direction and having a photosensitive layer on its one surface which is responsive to an exposure light beam so as to allow continuous formation of a plurality of images for each of a plurality of color pictures, said photosensitive means being equipped with a first reference mark indicate of a predetermined position of said photosensitive means in said first predetermined rotational direction;

first reference position sensor means for detecting said first reference mark of said photosensitive means and outputting a detection signal indicative of the detection of said first reference mark;

intermediate transfer means arranged to be rotatable with a second period in a second predetermined direction and arranged to be brought into contact with said photosensitive layer of said photosensitive means so that said plurality of images for each of said color pictures formed on said photosensitive layer are transferred onto a surface of said intermediate transfer means, the transferred images being integrally transferred onto a copy sheet to form each of said plurality of color pictures thereon, and said intermediate transfer means being equipped with a second reference mark indicative of a predetermined position of said intermediate transfer means in said second predetermined rotational direction;

second reference position sensor means for detecting said second reference mark of said intermediate transfer means and outputting a detection signal indicative of the detection of said second reference mark;

period difference calculating means responsive to said detection signals from said first and second reference position sensor means so as to calculate a difference between said first rotational period of said photosensitive means and said second rotational period of said intermediate transfer means and control means coupled to said period difference calculating means for controlling a start timing of the formation of each of said plurality of images on said photosensitive layer of said photosensitive means on the basis of the period difference calculated by said period difference calculating means, wherein control means determines said image-formation start timing as a time period from a time that said second reference position sensor outputs said detection signal indicative of the detection of said second reference mark of said intermediate transfer means.

7. An electrophotographic apparatus comprising:

photosensitive means arranged to be rotatable with a first period in a first predetermined direction and having a photosensitive layer on its one surface which is responsive to an exposure light beam so as to allow continuous formation of a plurality of images for each of a plurality of color pictures, said photosensitive means being equipped with a first reference mark indicate of a predetermined position of said photosensitive means in said first predetermined rotational direction;

first reference position sensor means for detecting said first reference mark of said photosensitive means and outputting a detection signal indicative of the detection of said first reference mark;

intermediate transfer means arranged to be rotatable with a second period in a second predetermined direction and arranged to be brought into contact with said photosensitive layer of said photosensitive means so that said plurality of images for each of said color pictures formed on said photosensitive layer are transferred onto a surface of said intermediate transfer means, the transferred images being integrally transferred onto a copy sheet to form each of said plurality of color pictures thereon, and said intermediate transfer means being equipped with a second reference mark indicative of a predetermined position of said intermediate transfer means in said second predetermined rotational direction;

second reference position sensor means for detecting said second reference mark of said intermediate transfer means and outputting a detection signal indicative of the detection of said second reference mark;

period difference calculating means responsive to said detection signals from said first and second reference position sensor means so as to calculate a difference between said first rotational period of said photosensitive means and said second rotational period of said intermediate transfer means and control means coupled to said period difference calculating means for controlling a start timing of the formation of each of said plurality of images on said photosensitive layer of said photosensitive means on the basis of the period difference calculated by said period difference calculating means, further comprising decision means for checking whether the image-formation start timing for a final image of said plurality of images for a first color picture of said plurality of color pictures which is determined by said control means is in a predetermined range based on a predetermined time period from a time that said first reference position sensor means outputs said detection signal indicative of the detection of said first reference mark of said photosensitive means, and wherein said control means determined the image-formation start timing for said final image as an image-formation start timing for a first image of said plurality of images for a second color picture of said plurality of color pictures when the image-formation start timing for said final image is in said predetermined range, and said control means sets the image-formation start timing for said first image for said second color picture to a predetermined start timing when it is out of said predetermined range.

8. An electrophotographic apparatus as claimed in claim 7, wherein said difference period calculating means calculates the period difference between said first and second rotational periods of both said photosensitive means and intermediate transfer means in response to turning-ON of a power source of said apparatus.

9. An electrophotographic apparatus as claimed in claim 7, wherein said difference period calculating means calculates the period difference between said first and second rotational periods of both said photosensitive means and said intermediate transfer means during the formation of a first image of said plurality of images for the first color picture.

10. An electrophotographic apparatus as claimed in claim 7, wherein said difference period calculating means calculates the period difference between said first and second rotational periods of both said photosensitive means and said intermediate transfer means during the formation of a first image of said plurality of images for each of said plurality of color pictures.

11. An electrophotographic apparatus as claimed in claim 7, wherein said difference period calculating means calculates the period difference between said first and second rotational periods of both said photosensitive means and said intermediate transfer means at every formation of each of said plurality of images for each of said plurality of color pictures, and said control means controls said image-formation start timing of the current image formation on the basis of the period difference calculated during the previous image formation.

* * * * *